US007848683B2

(12) United States Patent
Saito

(10) Patent No.: US 7,848,683 B2
(45) Date of Patent: Dec. 7, 2010

(54) POWDER DELIVERY MEMBER, AND POWDER DELIVERY APPARATUS, FRAME APPARATUS AND IMAGE FORMING APPARATUS USING THE SAME, AND MANUFACTURING APPARATUS FOR MANUFACTURING POWDER DELIVERY MEMBER

(75) Inventor: Kazuhiro Saito, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 551 days.

(21) Appl. No.: 11/863,351

(22) Filed: Sep. 28, 2007

(65) Prior Publication Data

US 2008/0260431 A1 Oct. 23, 2008

(30) Foreign Application Priority Data

Apr. 18, 2007 (JP) ..... 2007-109711

(51) Int. Cl.
*G03G 15/08* (2006.01)

(52) U.S. Cl. ..... 399/256

(58) Field of Classification Search ..... 399/256, 399/258, 254, 263; 222/DIG. 1
See application file for complete search history.

(56) References Cited

U.S. PATENT DOCUMENTS

| | | | | |
|---|---|---|---|---|
| 2003/0160385 | A1* | 8/2003 | Furusawa | 271/220 |
| 2004/0224245 | A1* | 11/2004 | Shigezaki et al. | 430/66 |
| 2006/0055959 | A1* | 3/2006 | Iwakura et al. | 358/1.14 |
| 2006/0233571 | A1* | 10/2006 | Askren et al. | 399/258 |

FOREIGN PATENT DOCUMENTS

| | | | |
|---|---|---|---|
| CN | 1746790 | A | 3/2006 |
| JP | 10-228220 | A | 8/1998 |
| JP | 11-52725 | A | 2/1999 |
| JP | 2001-350336 | A | 12/2001 |
| JP | 3587377 | B2 | 8/2004 |
| JP | 2005-70260 | A | 3/2005 |

OTHER PUBLICATIONS

Chinese Office Action dated May 20, 2010 in corresponding Chinese application No. 200710151447.9.

* cited by examiner

*Primary Examiner*—David P Porta
*Assistant Examiner*—Kiho Kim
(74) *Attorney, Agent, or Firm*—Sughrue Mion, PLLC

(57) ABSTRACT

A powder delivery member includes: a flexible axial core portion; and a powder delivering flexible vane portion formed on an outer periphery of the axial core portion.

17 Claims, 24 Drawing Sheets

POWDER DELIVERY MEMBER, AND POWDER DELIVERY APPARATUS, FRAME APPARATUS AND IMAGE FORMING APPARATUS USING THE SAME, AND MANUFACTURING APPARATUS FOR MANUFACTURING POWDER DELIVERY MEMBER

CROSS-REFERENCE TO RELATED APPLICATION

This application is based on and claims priority under 35 USC 119 from Japanese Patent Application No. 2007-109711 filed Apr. 18, 2007.

BACKGROUND

1. Technical Field

The present invention relates to a powder delivery member, and a powder delivery apparatus, a frame apparatus and an image forming apparatus respectively using such powder delivery member, and a manufacturing apparatus for manufacturing such power delivery apparatus.

2. Related Art

Recently, in an image forming apparatus such as a printer or a copying machine employing an electrographic system or a facsimile, its size and installation space have been reduced and, with such reduced size and space, the internal structure of such image forming apparatus has been complicated.

SUMMARY

According to an aspect of the invention, there is provided a powder delivery member including: a flexible axial core portion; and a powder delivering flexible vane portion formed on an outer periphery of the axial core portion.

BRIEF DESCRIPTION OF THE DRAWINGS

Exemplary embodiments of the present invention will be described in detail based on the following figures, wherein.

DETAILED DESCRIPTION

Now, description will be given below of the mode for carrying out the invention with reference to the accompanying drawings.

Exemplary Embodiment 1

Figure 2:
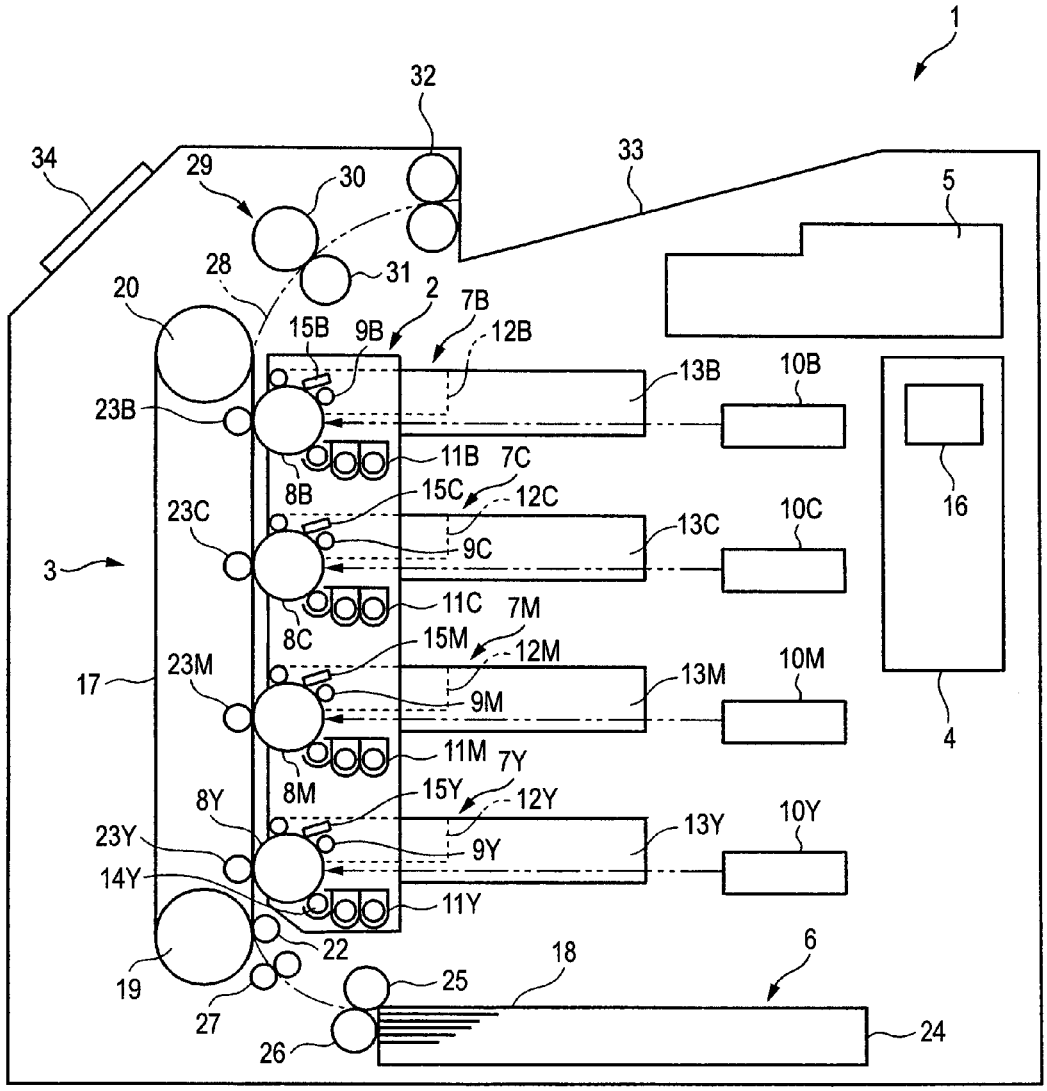
FIG. 2 illustrates a structure view of a tandem-type full-color printer functioning as an image forming apparatus of a sheet direct transfer type to which a powder delivery unit according to an exemplary embodiment 1 of the invention is applied.

FIG. 2 shows a tandem-type full-color printer functioning as an image forming apparatus of a sheet direct transfer type to which are applied a powder delivery member according to an exemplary embodiment 1 of the invention and a powder delivery apparatus using such power delivery member are applied. This full-color printer is structured such that it carries out a print operation according to image data which are transmitted from, for example, a personal computer and a scanner. By the way, the image forming apparatus, of course, can also be structured as a copying machine including a scanner, or a facsimile including a scanner, or a composite machine which has the functions of both of such copying machine and facsimile.

In FIG. 2, a reference numeral 1 designates the main body of a tandem-type full-color printer and, substantially in the central portion of the inside of the full-color printer main body 1, there is disposed a process cartridge 2 in such a manner that it extends along the vertical direction of the printer main body 1. Also, inside the full-color printer main body 1, on one side (in the illustrated example, on the left side) of the process cartridge 2, there is disposed a sheet delivery belt unit 3 for delivering a transfer member, to which there can be transferred more than one toner image formed by the process cartridge 2, in such a manner that the transfer member is attached to the sheet delivery belt unit 3. On the other side (in the illustrated example, on the right side) of the process cartridge 2, there is disposed a control unit 4 including a control circuit and the like; and, obliquely upward of the process cartridge 2, there is disposed a power supply circuit 5 including a high voltage power supply circuit and the like. Also, in the bottom portion of the full-color printer main body 1, there is provided a sheet supply device 6 which is used to supply a transfer sheet 18 or the like functioning as a transfer member.

The process cartridge 2 includes four image forming portions 7Y, 7N, 7C and 7B respectively for forming toner images of yellow (Y), magenta (M), cyan (C) and black (B), while these four image forming portions are arranged in ascending order from below; and also, these four image forming portions 7Y, 7M, 7C and 7B are arranged in a serial manner at given intervals along the vertical direction. By the way, although, in the process cartridge 2, the four image forming portions 7Y, 7M, 7C and 7B respectively for forming toner images of yellow (Y), magenta (M), cyan (C) and black (B) are formed as an integral body, of course, the process cartridge 2 may also be structured such that it is divided to four portions which respectively correspond to the four image forming portions 7Y, 7M, 7C and 7B respectively for forming toner images of yellow (Y), magenta (M), cyan (C) and black (B).

These four image forming portions 7Y, 7M, 7C and 7B are similar in structure to each other, except for colors to be formed thereby. Roughly, as shown in FIG. 2, each of them includes a sensitive drum 8 which can be rotated at a given rotation speed along the arrow mark direction, a primarily charging charger roller 9 for charging the surface of the sensitive drum 8 uniformly, a ROS (Raster Output Scanner) 10 for exposing a laser corresponding to its color to the surface of the sensitive drum 8 to form an electrostatic latent image on the sensitive drum 8, a developing device 11 functioning as a developing unit for developing the electrostatic latent image formed on the sensitive drum 8 using a toner of its corresponding color, a cleaning device 12 for cleaning a transfer residual toner left on the sensitive drum 8, and a toner cartridge 13 functioning as a developer storage part for supplying a toner to the developing device 11.

The developing device 11 is structured in the following manner: that is, as shown in FIG. 2, while mixing a developer composed of a two-component or a one-component powder stored therein, it supplies the developer to a developing roller 14; and, while regulating the layer thickness of the developer supplied to the developing roller 14, it delivers the developer to a developing area which is disposed opposed to the sensitive drum 8, thereby developing the electrostatic latent image formed on the surface of the sensitive drum 8 using a given color toner.

Also, the cleaning device 12, as shown in FIG. 2, removes the transfer residual toner left on the surface of the sensitive drum 8 using a cleaning blade 15, and delivers and stores the thus removed transfer residual toner into the inside of the cleaning device 12.

Further, inside the full-color printer main body 1, as shown in FIG. 2, there is disposed the control unit 4, while the control unit 4 includes therein, for example, an image processing apparatus (IPS) 16 which is used to enforce a given image processing on image data. The image processing apparatus 16 outputs the image data on the respective colors, that is, yellow (Y), magenta (M), cyan (C) and black (B) sequentially to the ROS 10, and four laser beams LB to be radiated from the ROS 10 according to the image data are respectively exposed and scanned onto their associated sensitive drums 8Y, 8M, 8C and 8B to thereby form electrostatic latent images on the respective sensitive drums 8Y, 8M, 8C and 8B. The electrostatic latent images formed on the respective sensitive drums 8Y, 8M, 8C and 8B are respectively developed by their associated developing devices 11Y, 11M, 11C and 11B as the toner images of the respective colors, namely, yellow (Y), magenta (M), cyan (C) and black (B).

Also, the sheet delivery belt unit 3, as shown in FIG. 2, includes a sheet delivery belt 17 made of an endless belt. The sheet delivery belt 17 is structured such that it delivers the transfer sheet functioning as a transfer member, to which the toner images of the respective colors, namely, yellow (Y), magenta (M), cyan (C) and black (B) formed by their respective image forming portions 7Y, 7M, 7C and 7B are to be transferred, in an electrostatically attached state.

The sheet delivery belt 17, as shown in FIG. 2, is extended between and over a drive roller 19 and a driven roller 20, which respectively function as extension rollers disposed along the vertical direction of the full-color printer main body 1, with a given tension; and, the sheet delivery belt 17 can be moved and circulated clockwise at a given speed by the drive roller 19 which can be driven and rotated by a drive motor (not shown).

The distance between the drive and driven rollers 19 and 20 is set for, for example, a length substantially equal to the length of the transfer sheet 18 of an A3 size. However, this is not limitative but, of course, the distance between the drive and driven rollers 19 and 20 may also be set for an arbitrary length. As the sheet delivery belt 17, for examples there is used a belt which can be produced by forming a synthetic resin film having flexibility made of polyimide or the like into an endless belt.

Also, on the surface of the drive roller 19, as shown in FIG. 2, there is disposed an attaching roller 22 for electrostatically attaching the transfer sheet 18 to the surface of the sheet delivery belt 17 in such a manner that it is contacted with the surface of the drive roller 19 through the sheet delivery belt 17. This attaching roller 22, for example, similarly to the charging rollers 9Y, 9M, 9C and 9B of the image forming portions 7Y, 7M, 7C and 7B, can be produced by covering the surface of a metal-made core with conductive rubber; and, a given bias voltage for attachment can be applied to the metal-made core. And, the attaching roller 22 is structured such that it can electrostatically charge the transfer sheet 18 fed from the sheet supplied device 6 to be thereby attached to the surface of the sheet delivery belt 17. By the way, it is not always necessary to provide the attaching roller 22.

The toner images of the respective colors, namely, yellow (Y), magenta (M), cyan (C) and black (B) respectively formed on their associated sensitive drums 8Y, 8M, 8C and 8B of the image forming portions 7Y, 7M, 7C and 7B, as shown in FIG. 2, are transferred in a multiple manner onto the transfer sheet 18, which is delivered in such a manner that it is attached to the surface of the sheet delivery belt 17, by their respective transfer rollers 23Y, 23M, 23C and 23B in such a manner that they are superimposed on top of each other. The transfer rollers 23Y, 23M, 23C and 23B are mounted on the sheet delivery belt unit 3 integrally therewith.

The transfer sheet 18, as shown in FIG. 2, is supplied from the sheet supply device 6 which is disposed in the bottom portion of the printer main body 1. This sheet feed device 6 includes a sheet tray 24 which stores therein the transfer sheet 18 having desired size and material quality. From the feed tray 24, the transfer sheets 18 having desired size and material quality are supplied by a supply roller 25. Specifically, the transfer sheets 18 are supplied one after another in such a manner that they are separated from each other by a handling roller 26, and the transfer sheets 18 are delivered at a given timing through a resist roller 27 functioning as a sheet supply unit to attaching positions on the sheet delivery belt 17.

As the transfer sheet 18, there can be used various members, provided that they are formed in a sheet-like shape. For example, there can be used sheet-shaped members which are made of various materials and have various sizes such as A4 size, A3 size, B5 size or B4 size; a common sheet; cardboard such as coat paper; and, an OHP sheet and the like.

And, the transfer sheet 18, on which the toner images of the respective colors, namely, yellow (Y), magenta (M), cyan (C), and black (B) are multi-color transferred, as shown in FIG. 2, is separated due to the rigidity (so called toughness) of the transfer sheet 18 itself and is then delivered through a delivery path 28 to a fixing device 29; and, the toner images of the respective colors are fixed on the transfer sheet 18 by the fixing device 29 using heat and pressure. The sheet delivery belt 17 and fixing device 29 are disposed adjacent to each other, and the transfer sheet 18, when it is separated from the sheet delivery belt 17, is then delivered to the fixing device 29 due to the delivery force of the sheet delivery belt 17. The fixing device 29 is structured such that it can drive and rotate a heating roller 30 and a pressurizing roller 31 in a mutually pressure contact state, and moves the transfer sheet 18 to a nip portion formed between the heating roller 30 and pressurizing belt 31 to thereby enforce a fixing processing on the transfer sheet 18 using heat and pressure. After then, the transfer sheet 18 with the toner images of the respective colors fixed thereon is discharged by a discharge roller 32 onto a discharge tray 33 with its print surface facing downward. This completes the print operation.

The above-mentioned full-color printer can print not only a full-color image but also an image of a desired color such as a monochrome image And, according to the color of an image to be printed, a toner image can be formed by all or part of the image forming portions 7Y, 7M, 7C and 73 of the respective colors, namely, yellow (Y), magenta (M), cyan (C), and black (B).

In FIG. 2, a reference numeral 34 designates an operation panel including a display portion such as a liquid crystal panel which is mounted on the front surface of the printer main body 1. The operation panel 34 is used to display the state of the printer and carry out necessary operations.

Now, an image forming apparatus according to the present exemplary embodiment includes an image carrier for forming an electrostatic latent image thereon according to image information, a developing unit for developing the electrostatic latent images formed on the image carrier, a developer storage portion for storing a developer, and a powder delivery unit for delivering the developer from the developer powder storage portion to the developing unit And, the powder delivery unit includes a powder delivering pipe-shaped member containing in at least a portion thereof a curved or bent non-linear portion, and a powder delivery member including an axial core portion disposed in the interior of the powder delivering pipe-shaped member and flexible in correspondence to the non-linear portion of the powder delivering pipe-shaped member and a powder delivering flexible vane portion disposed in the outer periphery of the axial core portion.

That is, the printer according to the present exemplary embodiment, as shown in FIG. 2, includes the toner cartridge 13Y, 13M, 13C and 13B respectively functioning as the developer storage portions which supply the toners of the respective colors, namely, yellow (Y), magenta (M), cyan (C) and black (B) to their associated developing devices 11Y, 11M, 11C and 11B of the corresponding colors, namely, yellow (Y), magenta (M), cyan (C) and black (B).

Figure 3:
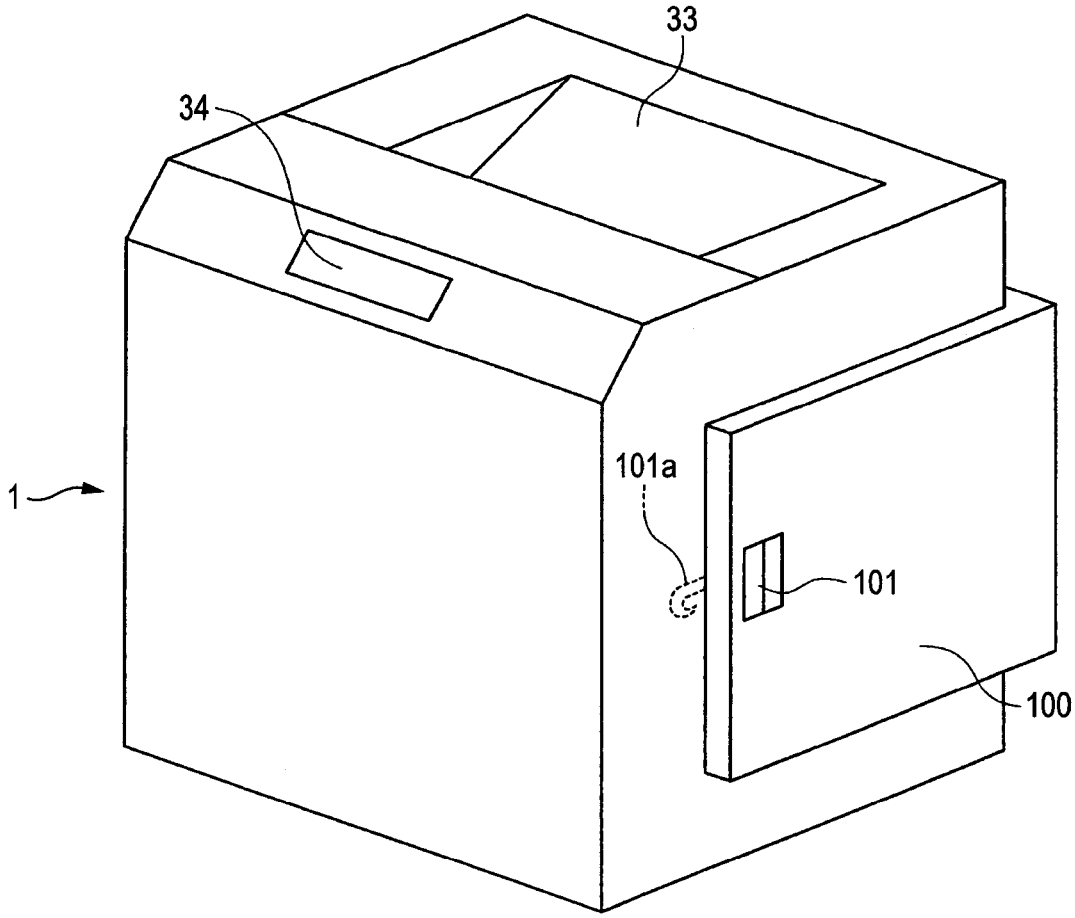
FIG. 3 illustrates a perspective outer view of a tandem-type full-color printer.
Figure 4:
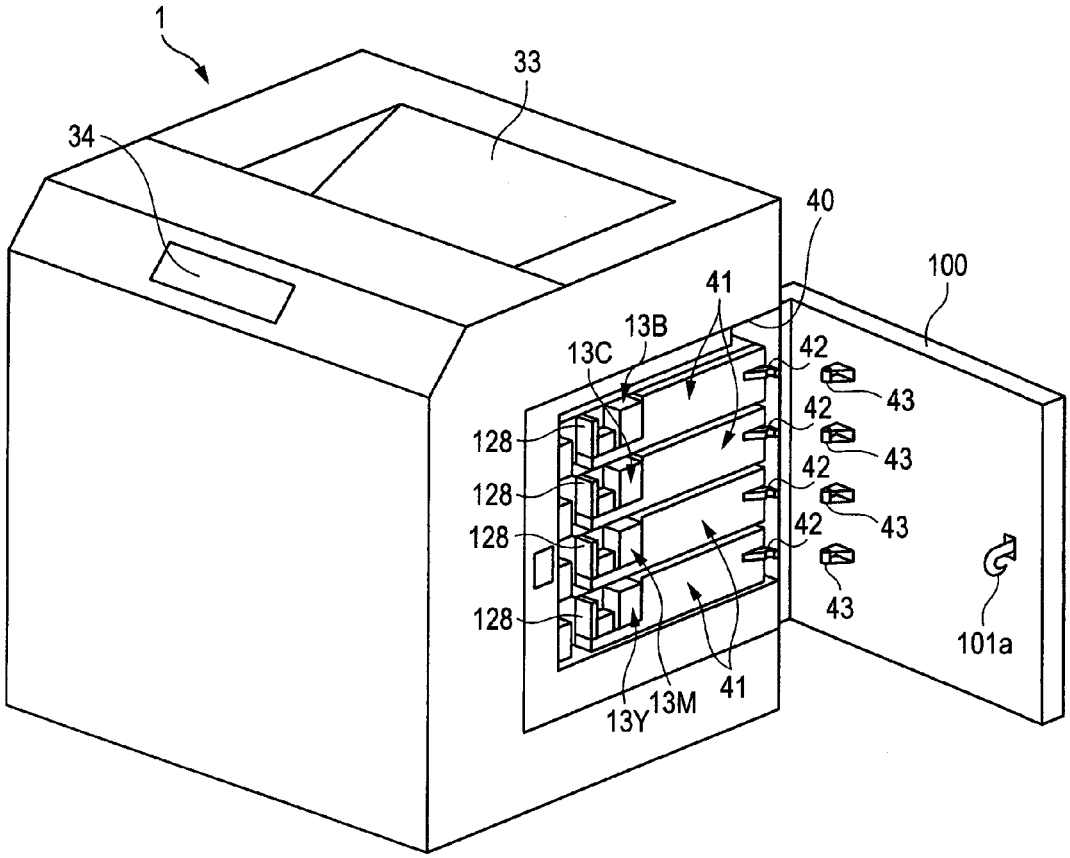
FIG. 4 illustrates a perspective outer view of a tandem-type full-color printer, showing a state where a cover is opened.

To mount these toner cartridges 13Y, 13M, 13C and 13B of the respective colors, namely, yellow (Y), magenta (M), cyan (C) and black (B), as shown in FIG. 3, an opening/closing cover 100 provided on the side surface of the printer main body 1 may be opened by pulling a knob 101 provided on the opening/closing cover 100 toward this side to thereby remove the locked state of a hook 101*a* and, as shown in FIG. 4, the toner cartridges 13Y, 13M, 13C and 13B may be removably mounted within an opening 40 exposed to the side surface of the printer main body 1 in such a manner that they are mounted on their respective cartridge holders 41. The toner cartridge 13Y, 13M, 13C and 13B are basically similar in structure to each other, except that the colors of the toners to be stored are different.

On each of the cartridge holders 41, as shown in FIG. 4, there is rotatably mounted an arm 42 in such a manner that its leading end portion projects out; and, the leading end portion of the arm 42 can be engaged with a portion to be engaged 43 which is formed in the opening/closing cover 100. In linking with the operation to open the opening/closing cover 100, the cartridge holders 41 are respectively swung apart from the printer main body 1 and are thereby moved to their mounting and removing positions.

Also, the toner cartridge 13Y, 13M, 13C and 13B can be respectively fixed by operating their associated handle members 128 respectively provided on the toner cartridges 13Y, 13M, 13C and 13B in a state where they are mounted at their respective operation positions within the opening 40 of the printer main body 1.

Figure 5:
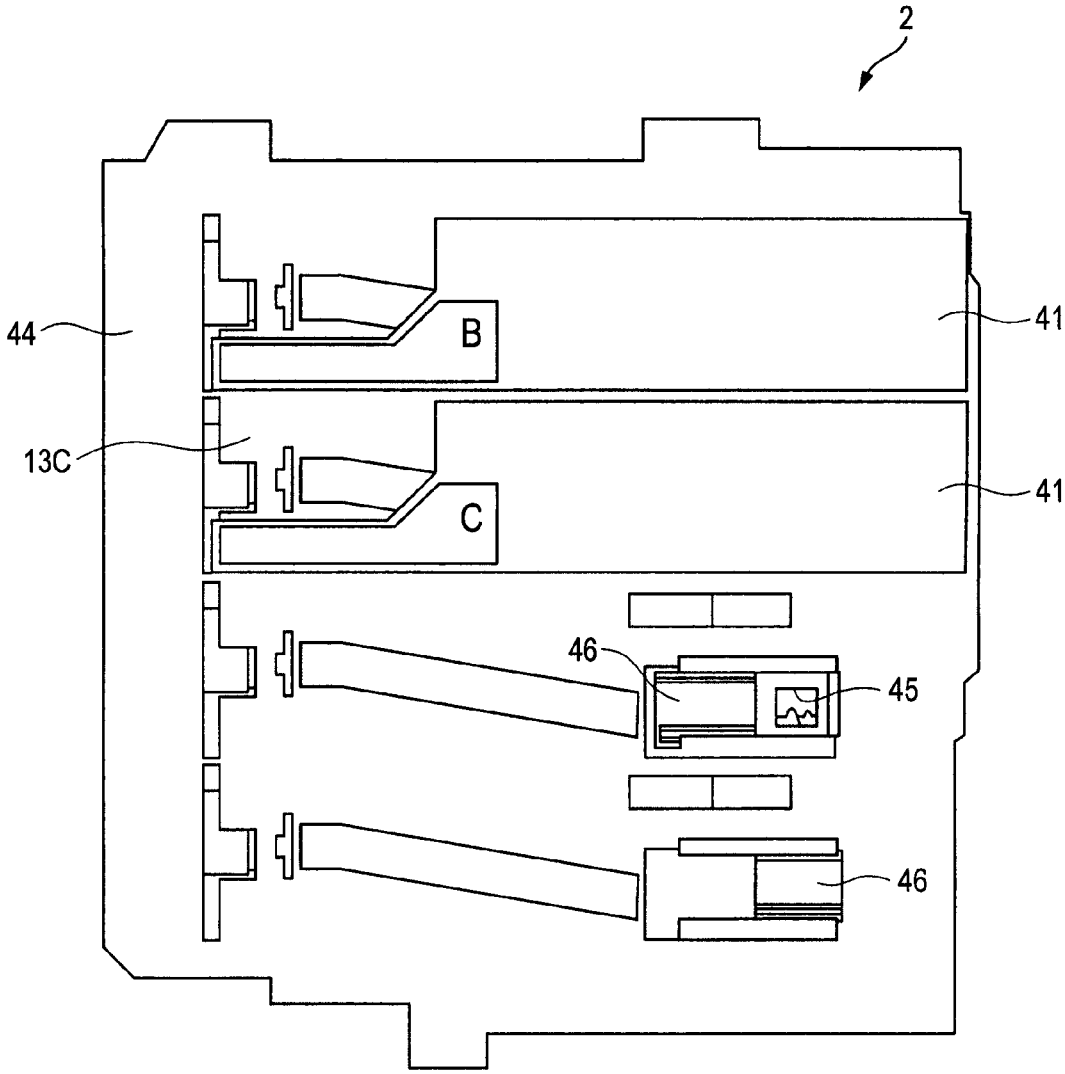
FIG. 5 illustrates a front structure view of the inside of a tandem-type full-color printer functioning as an image forming apparatus of a sheet direct transfer type to which a powder delivery unit according to an exemplary embodiment 1 of the invention is applied.

The toner cartridge 13Y, 13M, 13C and 13B are arranged in the side housing 44 of a frame functioning as a frame apparatus disposed within the printer main body 1 sequentially in ascending order, that is, yellow (Y), magenta (M), cyan (C) and black (B) from below in such a manner that, as shown in FIG. 5, they are respectively mounted on their associated cartridge holders 41. By the way, in FIG. 5, there is shown a state in which, for convenience, the toner cartridges 13Y and 13M of yellow (Y) and magenta (M) are removed together with their associated cartridge holders 41. The above-mentioned frame is formed of composite reinforced PPE or the like which is insulating resin.

In the side housing 44 of the frame, as shown in FIG. 5, there are opened up toner introduction openings 45 which are respectively used to introduce toners supplied from the toner cartridges 13Y, 13M, 13C and 13B; and, the toner introduction openings 45 can be respectively opened and closed by their associated shutter members 46 which are mounted slidably. By the way, in FIG. 5, there are shown a state in which the toner introduction opening 45 of yellow (Y) existing in the lower-most stage is closed by its associated shutter member 46, and a state in which the toner introduction opening 45 of magenta (M) existing in the second lowest stage is opened while its associated shutter member 46 is slided in the left direction.

Figure 6:
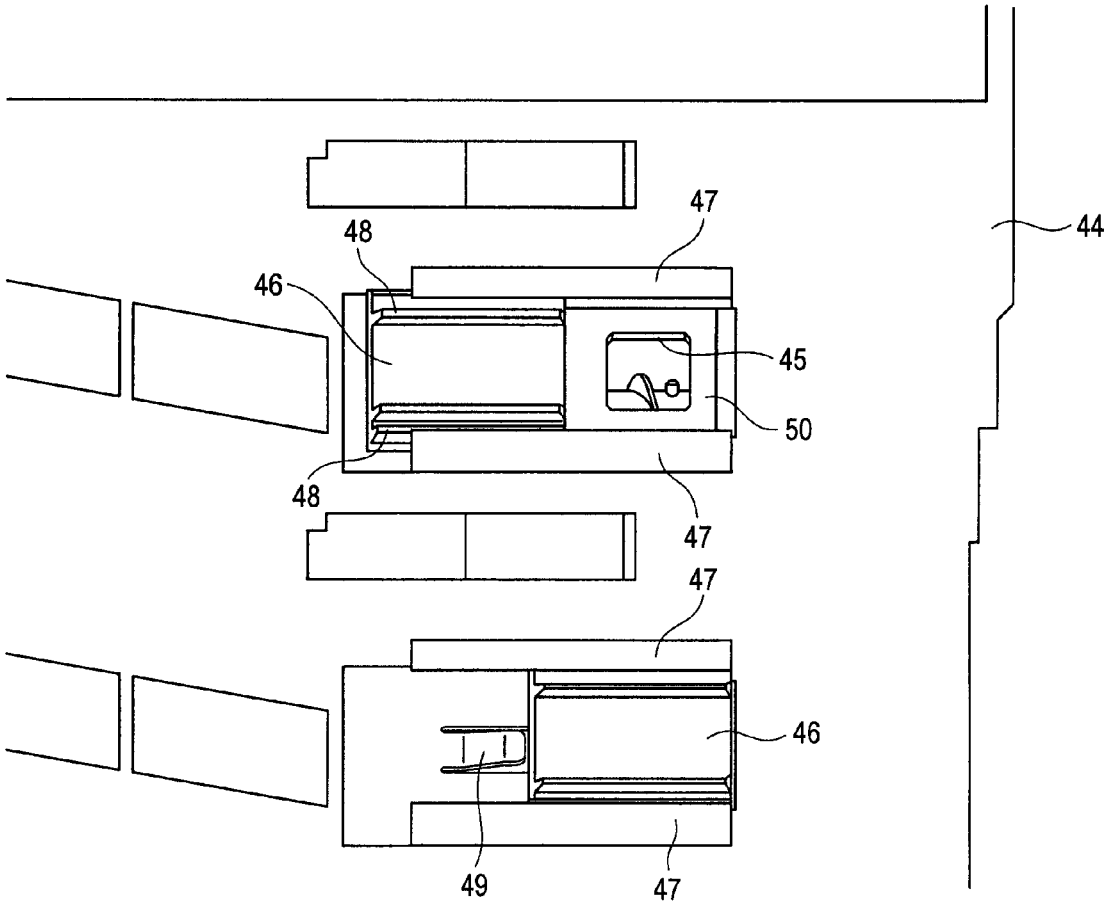
FIG. 6 illustrates an enlarged view of the main portions of FIG. 5.

Each of the shutter members 46, as shown in FIG. 6, is mounted in such a manner that it can be slided along a guide rail 47 provided in the side housing 44 and, on the surface of the shutter member 46, there is provided a projecting streak 48 which can be fitted with the guide rail 47. Also, the shutter member 46 is energized by a plate spring 49 provided in the side housing 44 in such a manner that it can be contacted with the guide rail 47. Further, on the outer peripheral surface of the toner introduction opening 45, there is provided a leakage preventive member 50 which is made of an elastic member such as a rubber or sponge member with a film or the like bonded thereto, in order to be able to prevent the leakage of the toner even when the shutter member 46 is in a slidable state. This leakage preventive member 50 prevents a clearance from occurring between the outer peripheral surface of the toner introduction opening 45 and the back surface of the shutter member 46 when the shutter member 46 is slided, thereby preventing the leakage of the toner.

Figure 7:
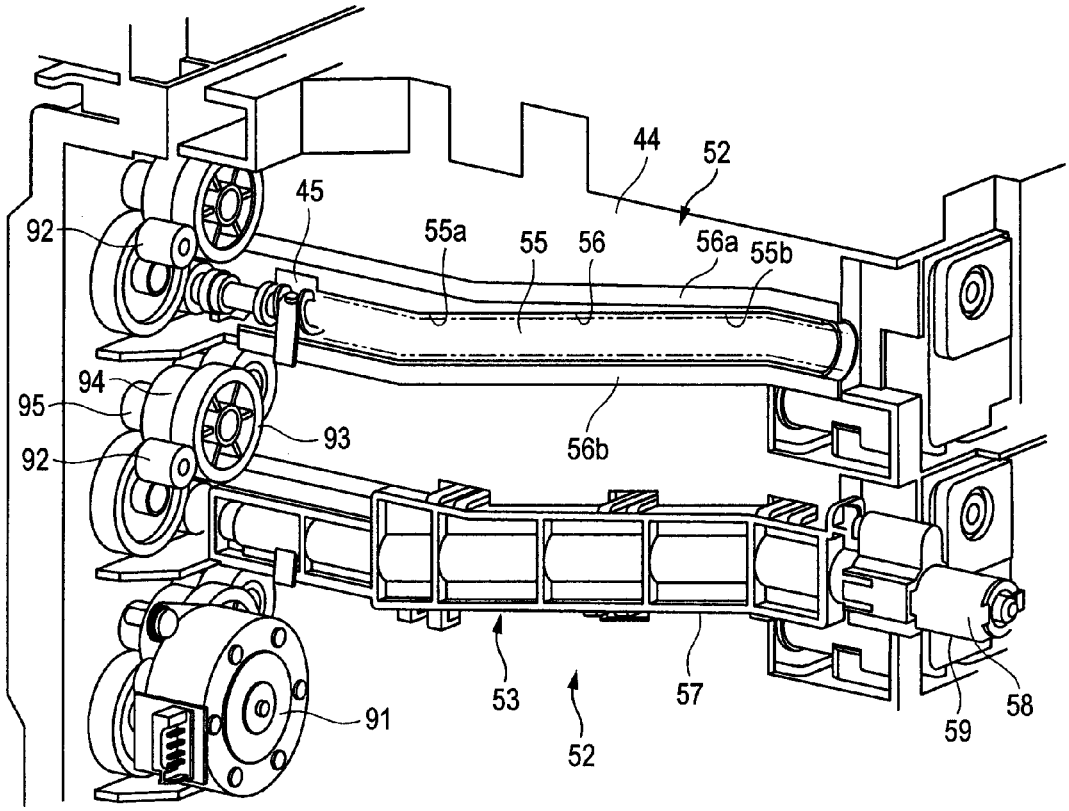
FIG. 7 illustrates a perspective structure view of the main portions of a tandem-type full-color printer functioning as an image forming apparatus of a sheet direct transfer type to which a powder delivery unit according to an exemplary embodiment 1 of the invention is applied.
Figure 8:
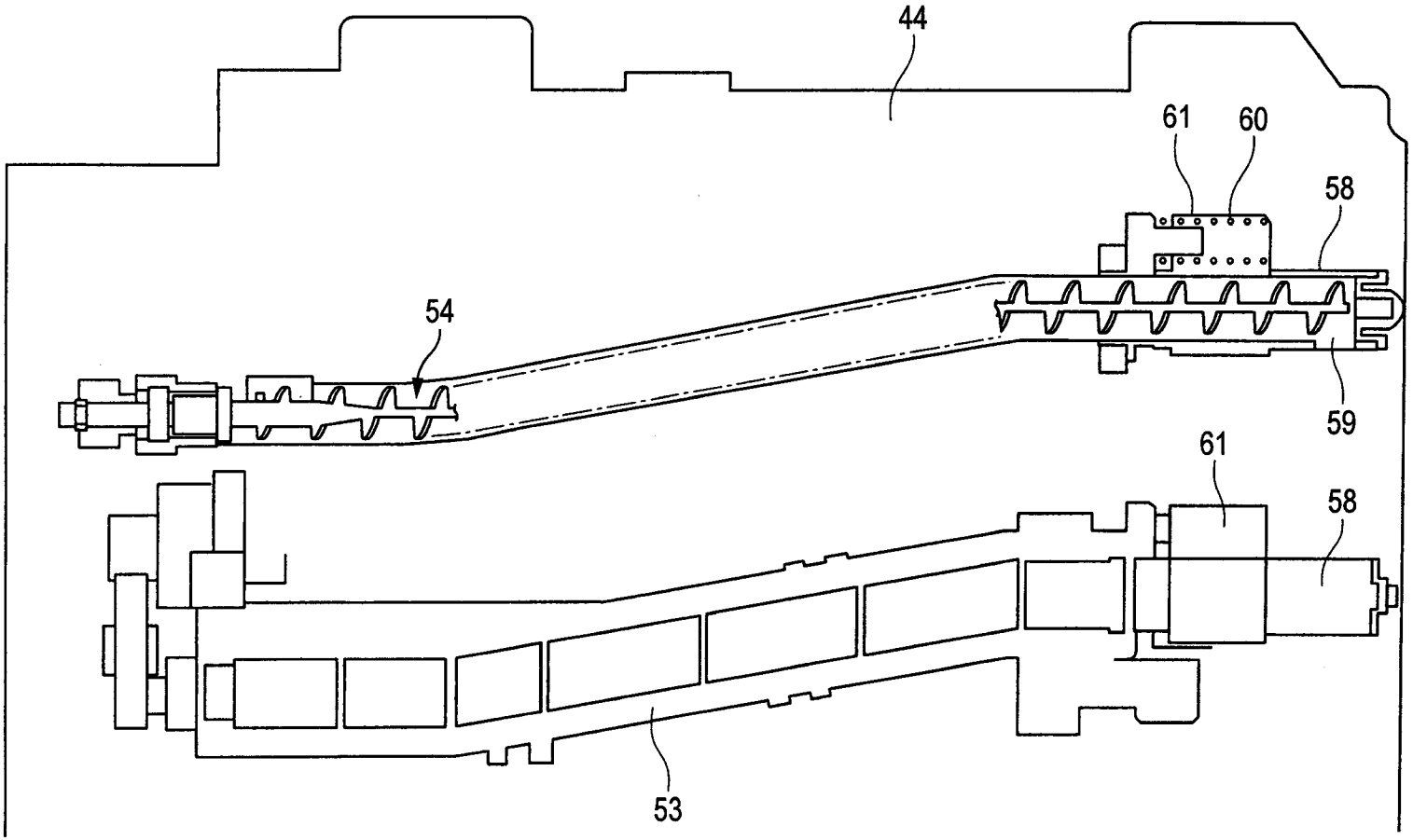
FIG. 8 illustrates a front view of the main portions of FIG. 7.

Further, on the side housing 44, as shown in FIGS. 7 and 8, there is mounted a toner delivery apparatus 52 functioning as a powder delivery apparatus which is used to deliver toners from the toner cartridges 13Y, 13M, 13C and 13B to their respective corresponding developing devices 11Y, 11M, 11C and 11B.

Referring further to the toner delivery apparatus 52, there are four toner delivery apparatuses 52 in correspondence to the toner cartridges 13Y, 13M, 13C and 13B of the respective colors, namely, yellow (Y), magenta (M), cyan (C) and black (B). The toner delivery apparatus 52, roughly, includes: a toner delivery pipe 53 functioning as a pipe-shaped member which includes, in at least a portion thereof, a curved or bent non-linear portion and is used to deliver a powder; and, a toner delivery member 54 including an axial core portion disposed inside the toner delivery pipe 53 and can be flexed in correspondence to the non-linear portion of the toner delivery pipe 53, and a flexible vane portion formed in the outer periphery of the axial core portion for delivery of the powder.

In the present exemplary embodiment, as shown in FIGS. 7 and 8, the toner introduction openings 45 corresponding to the toner supply openings of the toner cartridges 13Y, 13M, 13C and 13B are set relatively lower, while the toner supply openings 59 of the developing devices 11Y, 11M, 11C and 11B are set relatively higher. Therefore, a toner delivery path 55, which is defined by the toner delivery pipe 53 and has a circular section, is not linear as a whole but includes, in the intermediate portions thereof, a first curved or bent non-linear portion 55*a* and a second curved or bent non-linear portion 55*b*. The first and second non-linear portions 55*a* and 55*b* can be formed such that they are curved with a given radius of curvature, or can be bent such that their linear portions intersect each other at a given angle.

Figure 9:
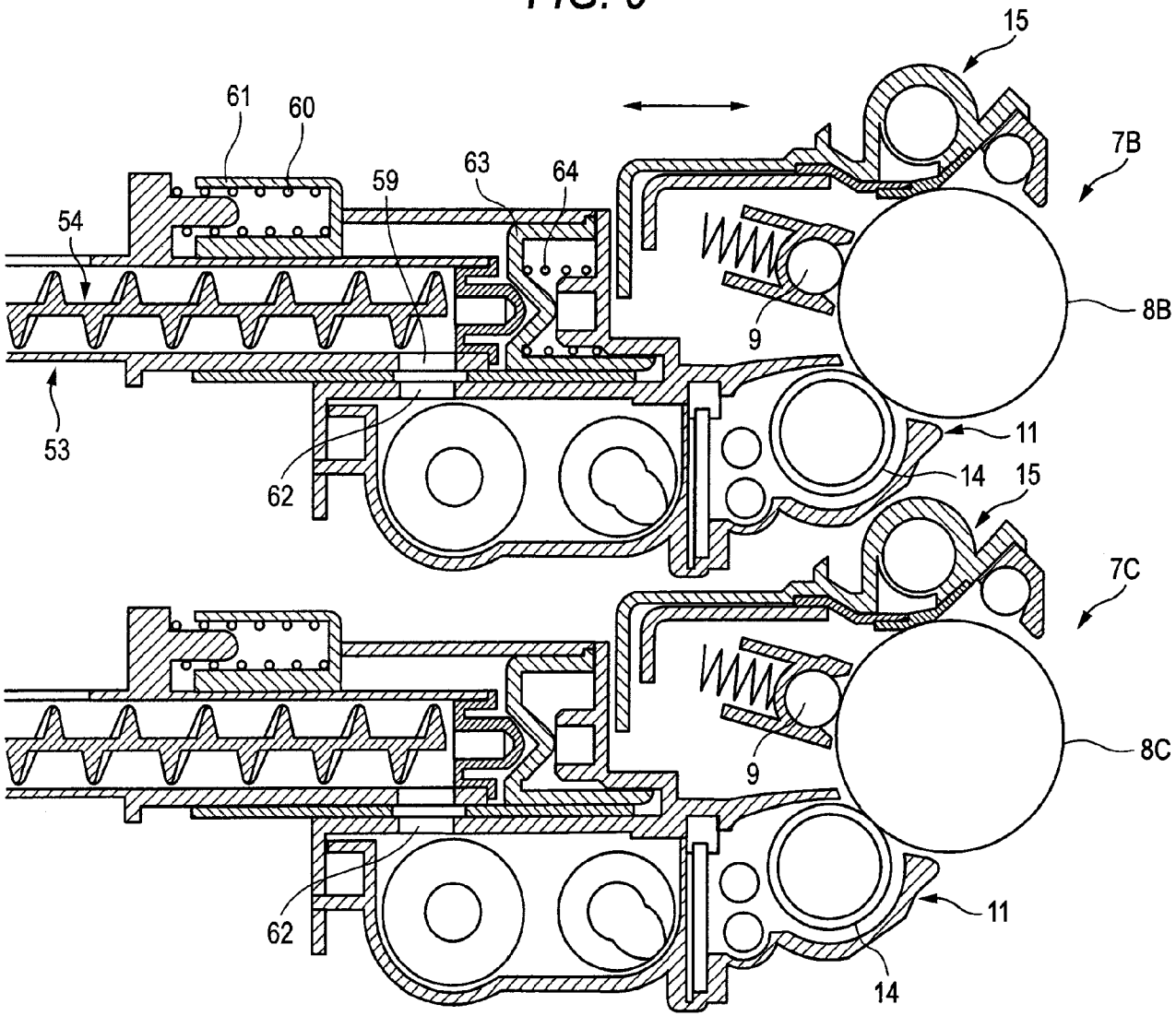
FIG. 9 illustrates a section view of the main portions of a tandem-type full-color printer functioning as an image forming apparatus of a sheet direct transfer type to which a powder delivery unit according to an exemplary embodiment 1 of the invention is applied.

The toner delivery pipe 53 is divided into two pipe portions along the vertical direction thereof. Specifically, one pipe portion of the toner delivery pipe 53, as shown in FIG. 7, is defined by a recessed groove 56 which is formed in the side housing 44 integrally therewith and has a semi-circular shaped section; and, the other pipe portion of the toner delivery pipe 53 is defined by a toner delivery path forming member 57 mounted on the side housing 44. Also, in order to prevent the occurrence of a clearance between the recessed groove 56 and toner delivery path forming member 57 when the toner delivery path forming member 57 is fixed, on the upper and lower sides of the recessed groove 56, there are disposed seal members 56*a* and 56*b* made of a sponge or the like respectively. And, the leading end portion 58 of the toner delivery pipe 53 is formed as a separate member. In the lower surface of the leading end portion 58, there is opened up the toner supply opening 59 which is used to supply the toner delivered by the toner delivery apparatus 52 to the toner developing device 11 by causing the toner to drop into the toner developing device 1 through the toner supply opening 59. Also, the toner supply opening 59, as shown in FIG. 9, can be opened and closed by a shutter member 61 which is normally energized in the closing direction by a coil spring 60. By the way, in FIG. 9, there is shown a state in which the shutter member 61 is opened and the toner supply opening 59 is thereby opened.

Also, as shown in FIG. 2, the image forming portions 7Y, 7M, 7C and 73 respectively for forming toner images of yellow (Y), magenta (M), cyan (C) and black (B) can be removably mounted into the process cartridge 2. Each of the image forming portions 7Y, 7M, 7C and 7B, as shown in FIG. 9, includes a sensitive drum 8 functioning as an image carrier, a charging roller 9 for charging the surface of the sensitive drum uniformly, a developing device 11 for developing an electrostatic latent image formed on the surface of the sensitive drum 8, and a cleaning device 15 for cleaning a toner left on the surface of the sensitive drum 8.

Figure 10:
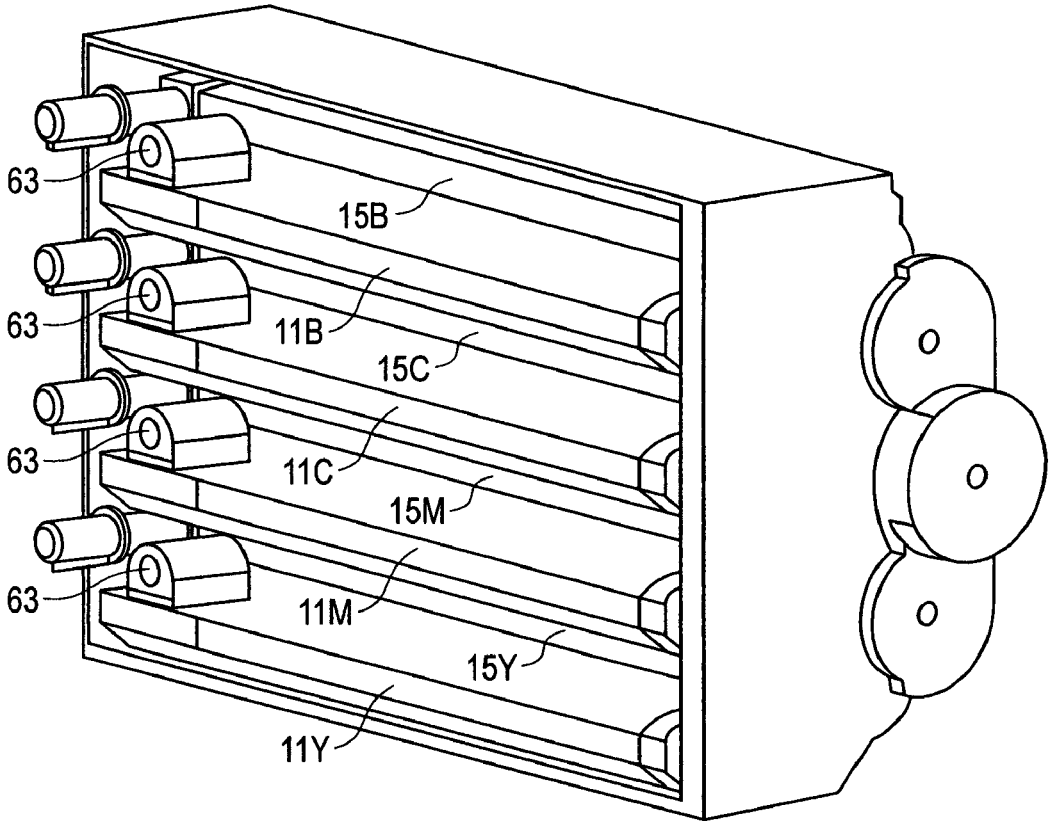
FIG. 10 illustrates a perspective structure view of the main portions of a tandem-type full-color printer functioning as an image forming apparatus of a sheet direct transfer type to which a powder delivery unit according to an exemplary embodiment I of the invention is applied.

Each of the image forming portions 7Y, 7M, 7C and 7B, as shown in FIG. 10, is formed as a unified body, while the image forming portions 7Y, 7M, 7C and 7B are respectively mounted in such a manner that they can be slided in the horizontal direction. And, in the upper end face of the developing device 11, there is opened up a toner supply opening 62 which is used to supply a toner. The toner supply opening 62 formed in the developing device 11, as shown in FIG. 9, can be opened and closed by a slide member 63. The slide member 63 is structured in the following manner. That is, the slide member 63 is energized in the projecting direction by a spring 64. When the image forming portions 7Y, 7M, 7C and 7B are moved in a direction where they are removed from the process cartridge 2 (in FIG. 9, in the right direction), the slide members 63 automatically close their associated toner supply openings 62.

And, to the toner supply opening 62 of the developing device 11, as shown in FIG. 9, there is supplied a toner, which has been delivered within the toner delivery pipe 53 by the toner delivery member 54 of the toner delivery apparatus 52, in such a manner that it drops down from the toner supply opening 59.

Figure 1:
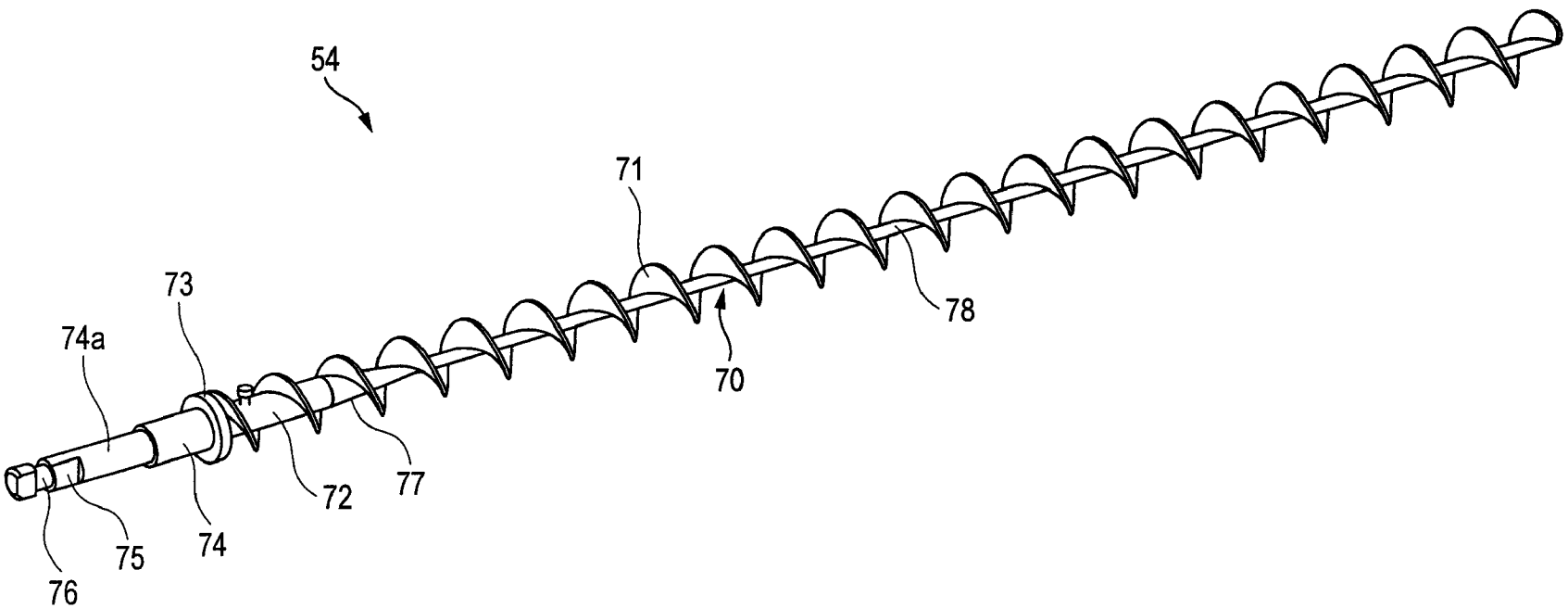
FIG. 1 illustrates a perspective structure view of a powder delivery unit according to an exemplary embodiment 1 of the invention.

By the way, the toner delivery member 54, as shown in FIG. 1, includes a flexible axial core portion 70 and a powder delivering flexible vane portion 71 formed in a spiral shape on the outer periphery of the axial core portion 70. This toner delivery member 54 is formed as a unified body according to an injection molding method which can use synthetic resin such as polyoxymethylene (POM), nylon, polyethylene (PE) and polyethylene terephthalate (PET) as the forming material of the toner delivery member 54. Specifically, according to the present exemplary embodiment, as the material of the toner delivery member 54, there is used POM which has flexibility and highly slidable. The POM, even when it is rotated while in contact with other member, provides a small friction coefficient and produces little friction heat with respect to the other member.

The axial core portion 70 of the toner delivery member 54, as shown in FIG. 1 includes, on one end side thereof, a large diameter section 72 which is small in length and has a relatively large diameter; and, on the end portion of the large diameter section 72, there is integrally formed a bearing section 74 through a flange section 73. The leading end side 74*a* of the bearing section 74 is formed small in diameter. In the end of the leading end side 74*a*, there are formed not only a reference surface 75 cut substantially in a D shape for mounting a drive gear which drives and rotates the toner delivery member 54, but also a groove 76 for insertion of a fixing member which is used to fix the drive gear in a removal preventive manner.

The axial core portion 70 further includes a small diameter section 78 which is relatively small in diameter and also which, through a short tapered section 77 formed continuous with the large diameter section 72 and gradually decreasing in diameter, extends long over the whole length of the remaining areas of the axial core portion 70. The diameter of the small diameter section 78 is set very small (fine), for example, about 1.5 mm. This small diameter structure cooperates together with the material of the axial core portion 70 in allowing the axial core portion 70 to flex easily.

Further, the powder delivering vane portion 71, as shown in FIG. 1, extends continuously with the flange section 73 of the axial core portion 70 and is formed as a unified body in a spiral shape at a constant pitch up to the end of the small diameter section 78. The outside diameter of the powder delivering vane portion 71 depends on the diameter of the circular-section toner delivery path 55. According to the present exemplary embodiment, the outside diameter of the vane portion 71 is set 8 mm and the diameter of the toner delivery path 55 is set 9 mm.

Figure 11:
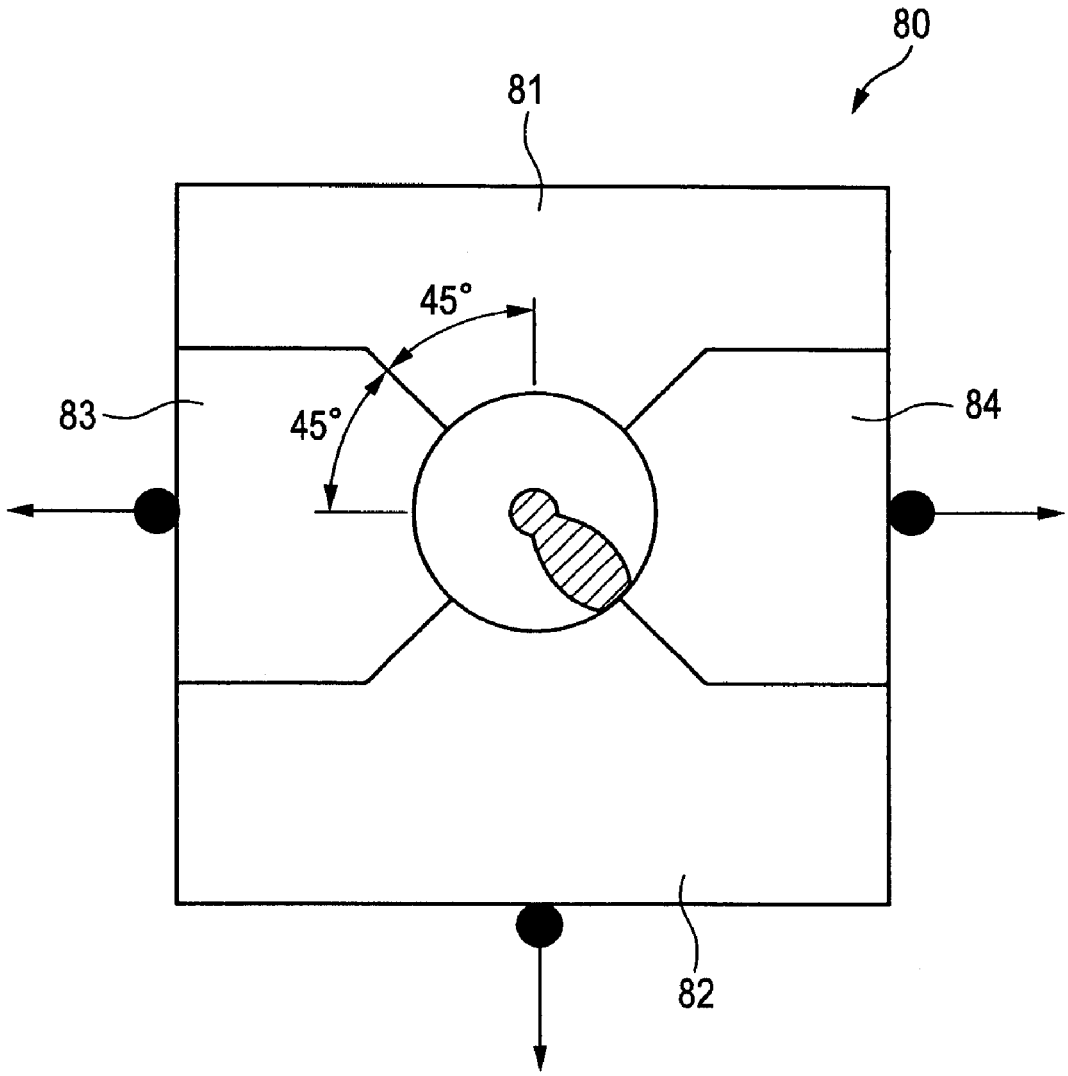
FIG. 11 illustrates a structure view of a die assembly functioning as a manufacturing apparatus for manufacturing a powder delivery member according to an exemplary embodiment 1 of the invention.

FIG. 11 shows a die assembly functioning as a manufacturing device for manufacturing the toner delivery member 54 as an integral body by injection molding synthetic resin.

The toner delivery member manufacturing die assembly 80 is composed of a first die 81 and a second die 82, which are disposed in upper and lower positions respectively, as well as a third die 83 and a fourth die 84 disposed in left and right positions respectively, in such a manner that, in a plane intersecting at right angles to the longitudinal direction of the toner delivery member 54, the first to fourth dies can divide the powder delivering vane portion 71 of the toner delivery member 54 into four sections along the peripheral direction of the vane portion 71 as well as the four dies can be removed therefrom.

Figure 12:
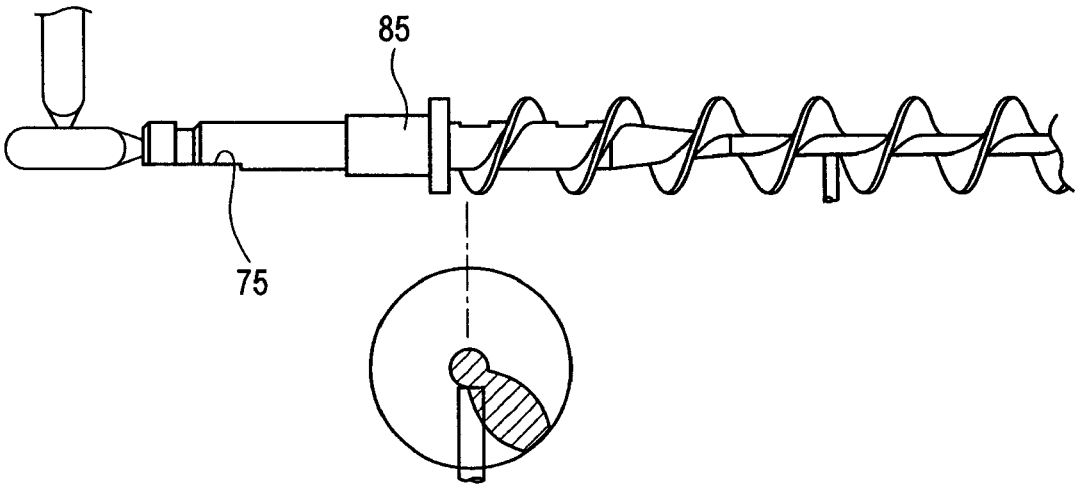
FIG. 12 illustrates a structure view of a cavity formed in a die assembly functioning as a manufacturing apparatus for manufacturing a powder deliver member according to an exemplary embodiment 1 of the invention.
Figure 13:
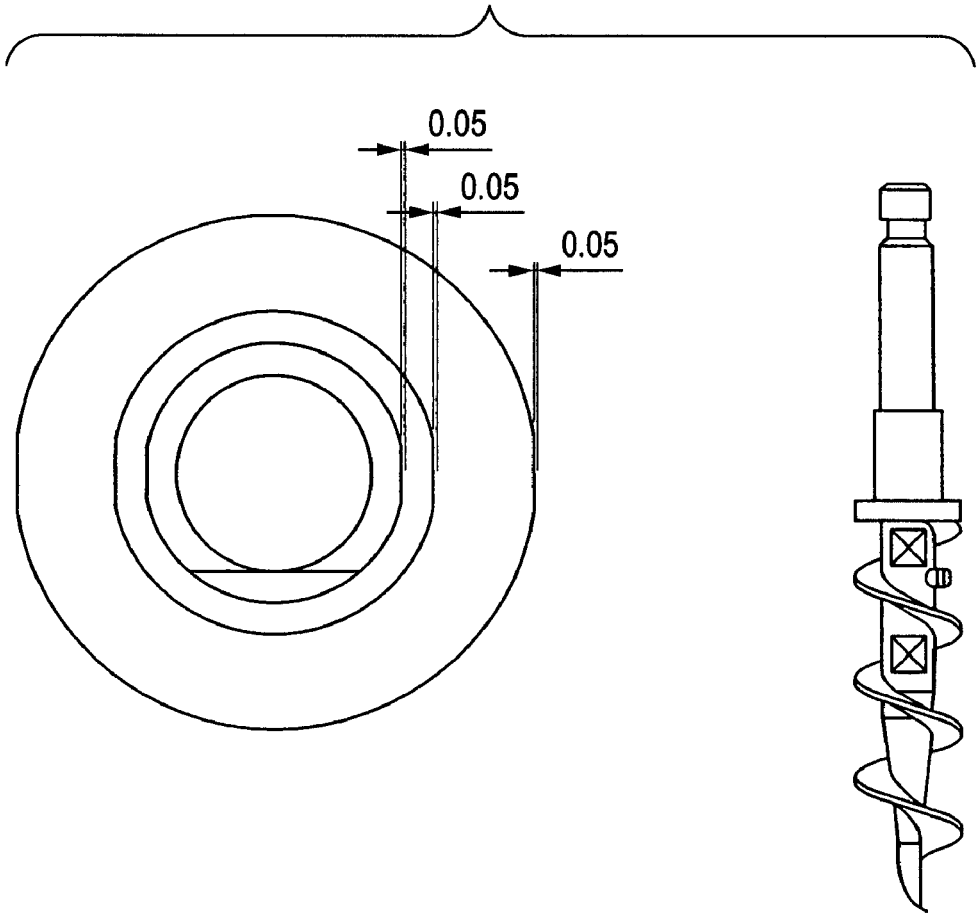
FIG. 13 illustrates a structure view of the main portions of a die assembly functioning as a manufacturing apparatus for manufacturing a powder deliver member according to an exemplary embodiment 1 of the invention.

Also, inside the first die 81 to fourth die 84, as shown in FIG. 12, there is formed a cavity 85 which is a space corresponding to the shape of the toner delivery member 54. The cavity 85 is formed in such a manner not only that, as described above, in a state where the substantially D-shaped cut reference surface 75 of the toner delivery member 54 faces downward, the powder delivering vane portion 71 of the toner delivery member 54, in a plane intersecting at right angles to the longitudinal direction of the toner delivery member 54, is divided along the peripheral direction thereof into four sections by planes respectively forming an oblique angle of 45 degrees with respect to the horizontal and vertical directions thereof, but also that the die assembly 80, that is, the first to four dies 81 to 84 can be removed therefrom.

Figure 16:
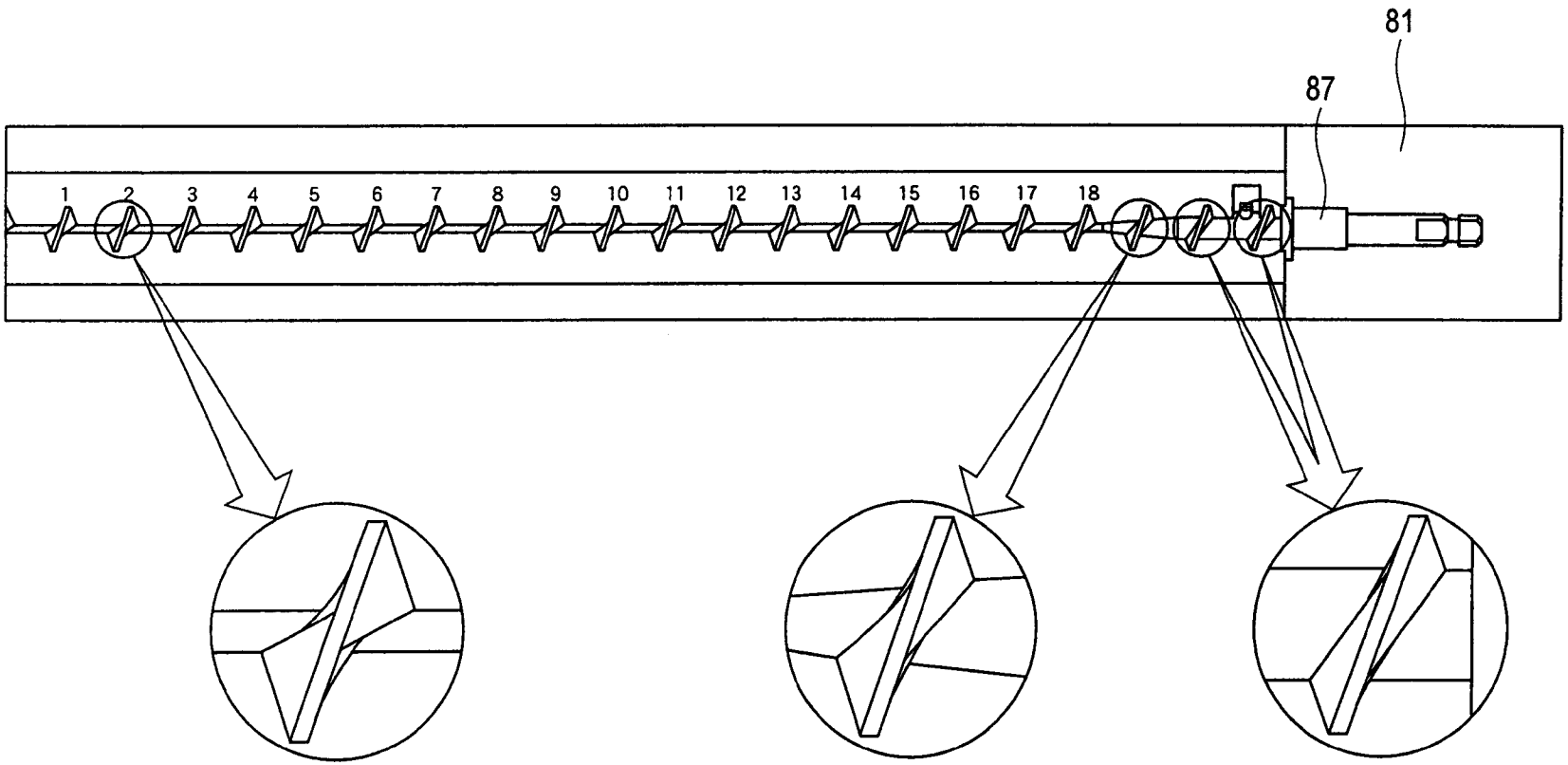
FIG. 16 illustrates a structure view of a cavity formed in a die assembly functioning as a manufacturing apparatus for manufacturing a powder deliver member according to an exemplary embodiment 1 of the invention.

In manufacturing the toner delivery member 54 using the above-mentioned die assembly, of the shape of the toner delivery member 54, the portion of the toner delivery member 54 corresponding to the spiral-shaped powder delivering vane portion 71 provides an obstacle to the removal of the die assembly 80. The shape of the vane portion 71 is designed such that it does not provide an obstacle when removing the first die 81 to fourth die 84 in the upper and lower direction as well as in the right and left direction. Specifically, the shape of a curved surface forming the surface of the vane portion 71 corresponding portion of the member 54 is designed such that, as shown in FIG. 16, it extends at least parallel to planes in the upper and lower directions as well as in the right and left directions, or narrows toward the cavity 85 in the depth direction of the die assembly 80.

Also, the cavity 85 formed inside the first die 81 to fourth die 84 is structured in the following manner. That is, as shown in FIGS. 12 to 15, the shape of the vane portion 71 corresponding portion of the member 54 has rotational symmetry For this reason, in order that, when the vane portion 71 corresponding portion of the member 54 is viewed from front, the 45-degree area thereof with the axial core portion 70 as a center thereof can provide an area which allows the removal of the dies, the portion of the cavity 85 existing on the back surface side of the spiral-shaped vane portion 71 is slightly increased in thickness.

Figure 14:
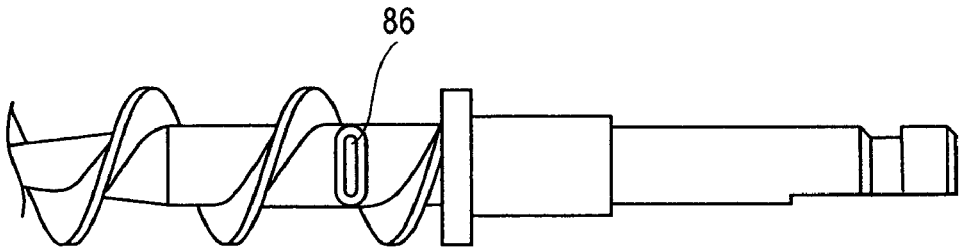
FIG. 14 illustrates a structure view of the main portions of a powder deliver member according to an exemplary embodiment 1 of the invention.
Figure 15:
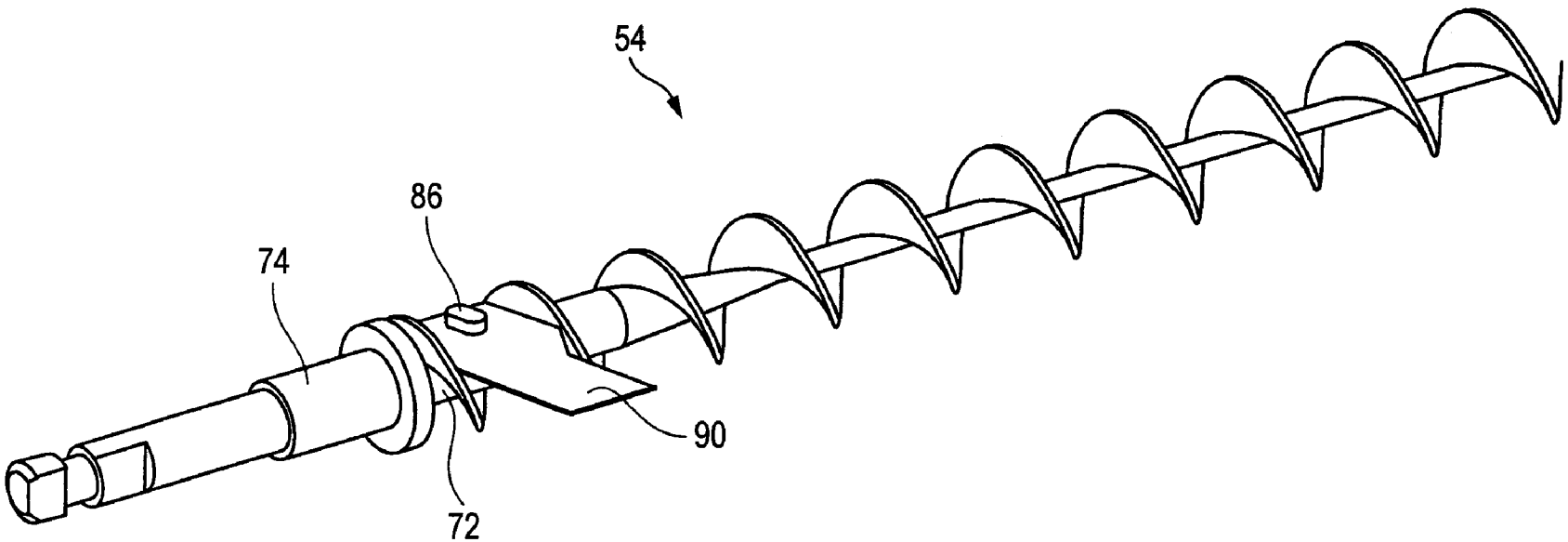
FIG. 15 illustrates a perspective structure view of a powder deliver member according to an exemplary embodiment 1 of the invention.

Further, in the cavity 85 defined by the first die 81 to fourth die 84, as shown in FIGS. 14 and 15, there is formed a portion which corresponds to a securing portion 86.

And, since the bearing section 74 of the toner delivery member 54 has a columnar shape, it is formed by a cavity 87 which is provided by the upper and lower, namely, first and second dies 81 and 82.

Figure 17:
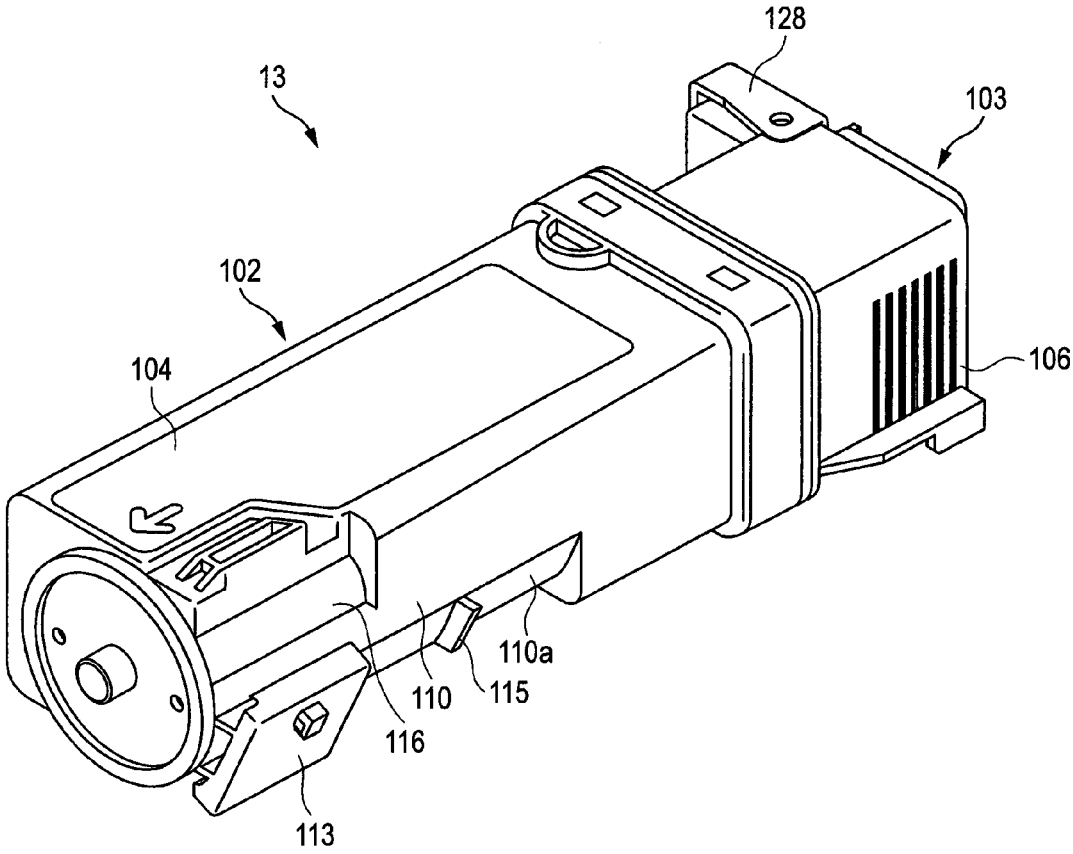
FIG. 17 illustrates a perspective outer view of a toner cartridge functioning as a developer storage portion.
Figure 18:
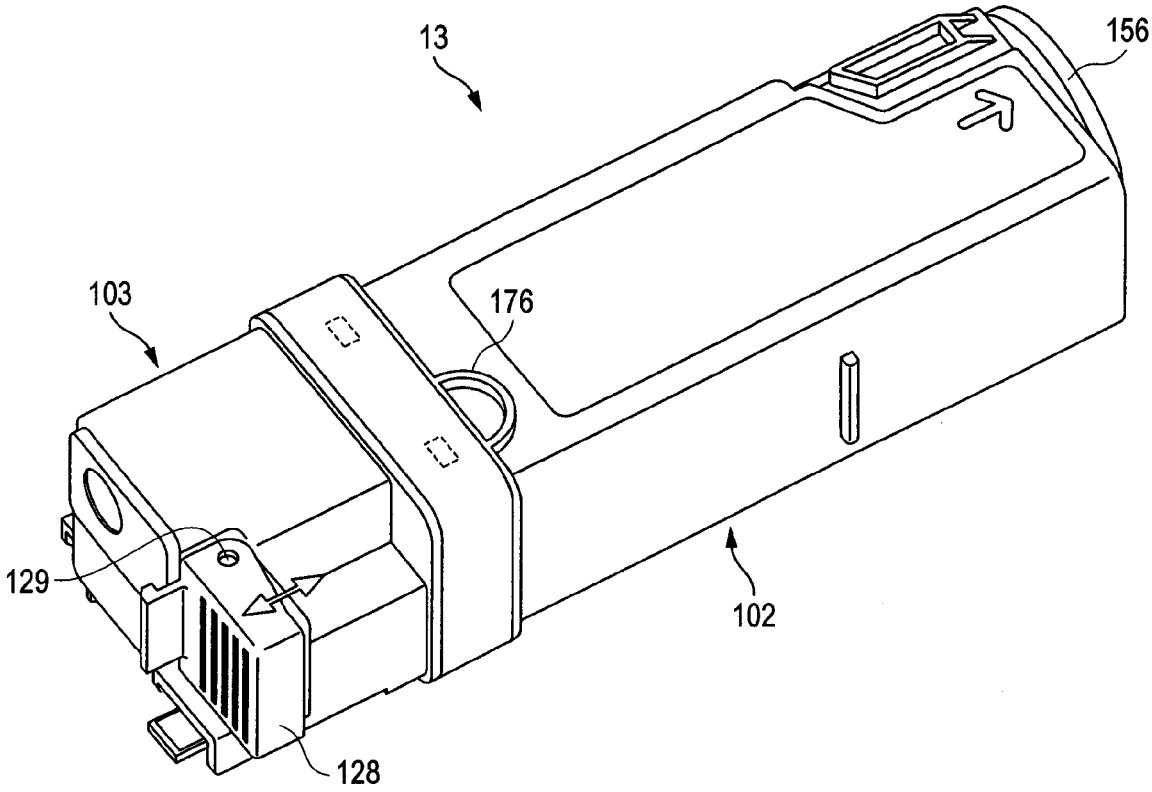
FIG. 18 illustrates a perspective outer view of a toner cartridge functioning as a developer storage portion.

Now, FIGS. 17 and 18 are perspective external views of a toner cartridge functioning as a developer storage portion, when viewed from different directions.

In FIGS. 17 and 18, reference numeral 13 designates a toner cartridge. The toner cartridge 13 is structured as a box body which is formed long and narrow in a substantially rectangular shape. The toner cartridge 13 includes a new toner storage portion 102 functioning as a developer storage portion for storing a new toner or a developing powder composed of a new toner and a carrier, and a collected toner storage portion 103 functioning as a collected developer storage portion which is connected to one end portion of the new toner storage portion 102 in the longitudinal direction thereof and is used to store a collected toner removed by the cleaning device 12, or a collected toner or collected developing powder collected from the developing device 11. According to the present exemplary embodiment, the collected toner storage portion 103 stores a collected toner removed by the cleaning device 12. The new toner storage portion 102 is set larger in volume than the collected toner storage portion 103. The new toner storage portion 102 is set, for example, such that it occupies about ¾ of the volume of the toner cartridge 13. However, of course, the volume of the new toner storage portion 102 may be larger or smaller than the above set volume.

The new toner storage portion 102, as shown in FIG. 17, includes a new toner storage vessel 104 which constitutes the new toner storage portion 102. The new toner storage vessel 104 is formed as a box member which has a long and narrow, substantially rectangular shape and also has a fully opened opening 105 formed in the end face thereof on the collected toner storage portion 103 side. Also, the collected toner storage portion 103 includes a collected toner storage vessel 106 which constitutes the collected toner storage portion 103. The collected toner storage vessel 106 is formed as a box member which has a substantially cubic shape and also a fully opened opening 107 formed in the end face thereof on the new toner storage portion 2 side. It is desirable that the new toner storage portion 102 and collected toner storage vessel 6 are formed in a substantially rectangular shape or in a substantially cubic shape, because they can store a large quantity of toners and collected toners in a limited installation space. However, the shape of them is not always limited to the substantially rectangular or cubic shape but, of course, it may also be a cylindrical shape or a polygonal shape.

Figure 19:
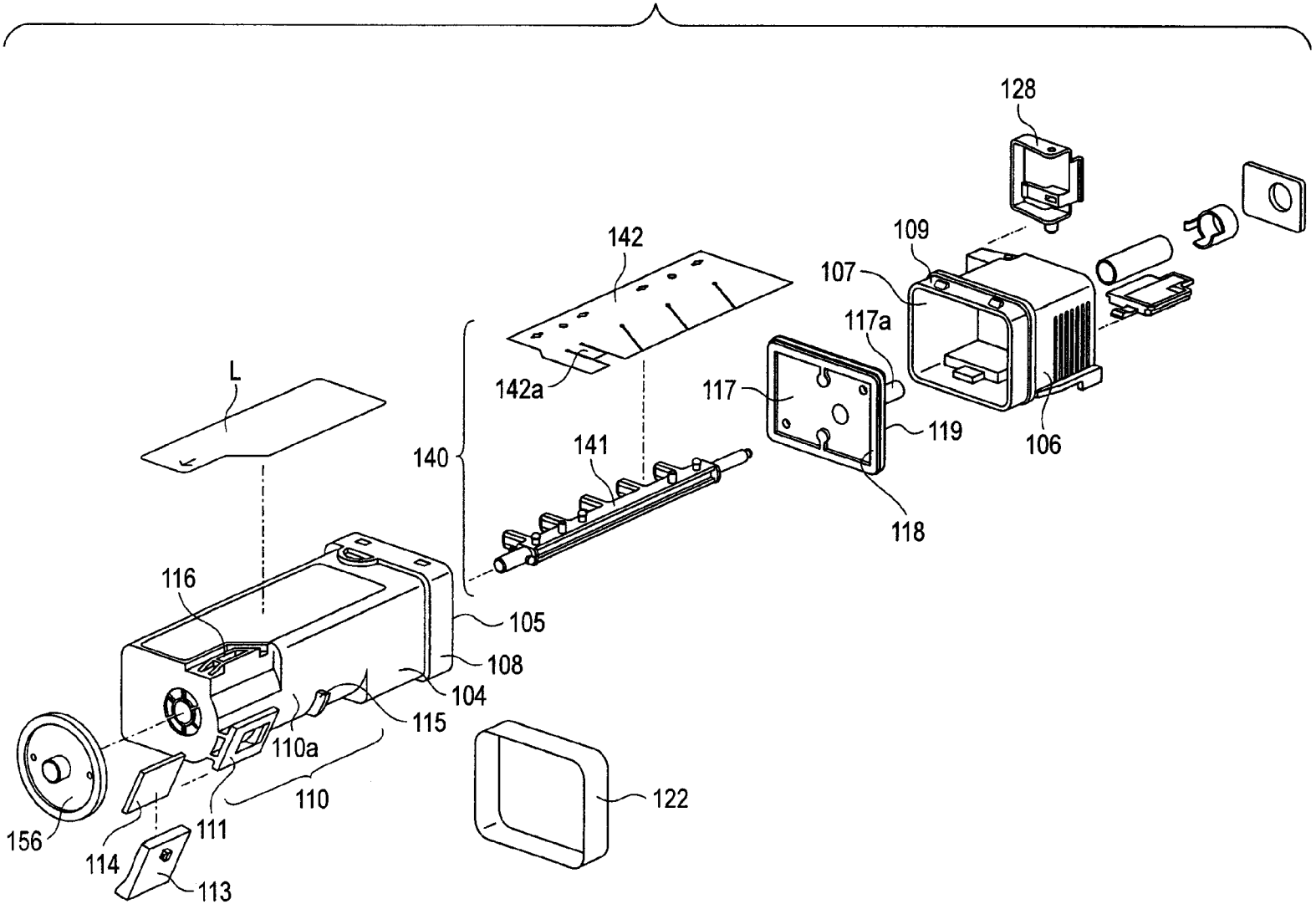
FIG. 19 illustrates an exploded perspective view of a toner cartridge functioning as a developer storage portion.

Further, on the opening 105 side end portion of the new toner storage vessel 104, as shown in FIG. 19, there is provided a rectangular-shaped connecting portion 108 which has a similar shape to the new toner storage vessel 204 and is a size bigger than this; and, on the opening 107 side of the collected toner storage vessel 106, there is provided a connecting portion 109 which can be fitted with the inner periphery of the connecting portion 108 of the new toner storage vessel 104.

Figure 20A:
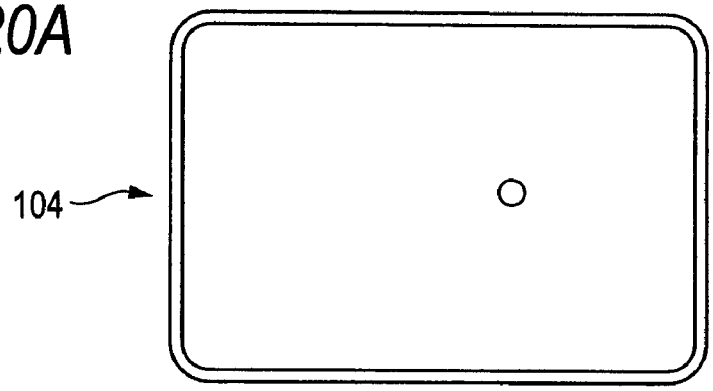
FIGS. 20A to 20C illustrate section views of the main portions of a toner cartridge functioning as a developer storage portion.
Figure 20B:
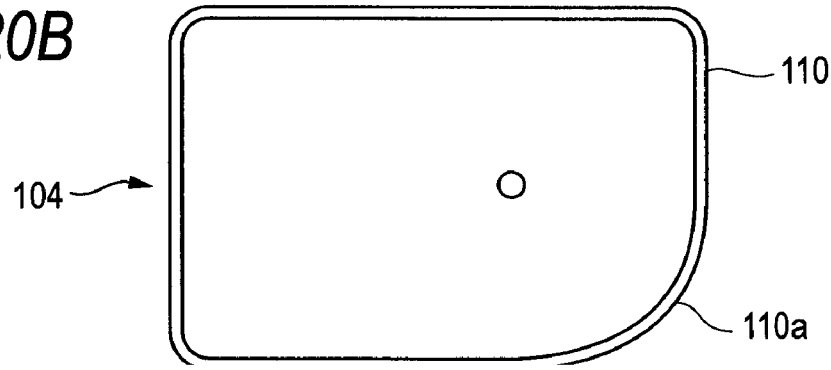
Figure 20C:
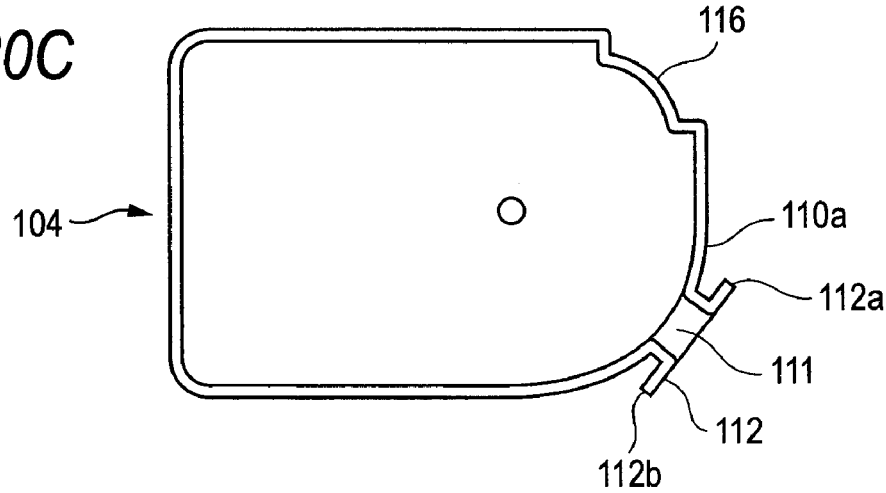

Also, the new toner storage vessel 104, as shown in FIG. 20A, is formed such that its section has a substantially rectangular section. And, the portion 110 of the new toner storage vessel 104, which exists on the opposite side to the opening 105 along the longitudinal direction thereof and occupies about ⅔ of the new toner storage vessel 104, as shown in FIG. 20B, includes a side surface 110*a* which exists in the right lower area of the portion 110 and has an arc-like shape. In the longitudinal direction end portion of the arc-shaped side surface 110*a*, as shown in FIG. 20C, there is opened up a toner supply opening 111 which is used to supply a toner to the developing device 11. On the outside of the toner supply opening 111, there is integrally provided a square-shaped frame portion 112 in a projecting manner, while the vertical-direction end edges 112*a* and 112*b* cooperate together in constituting a guide member for guiding a shutter 113 (which will be discussed later).

Figure 21:
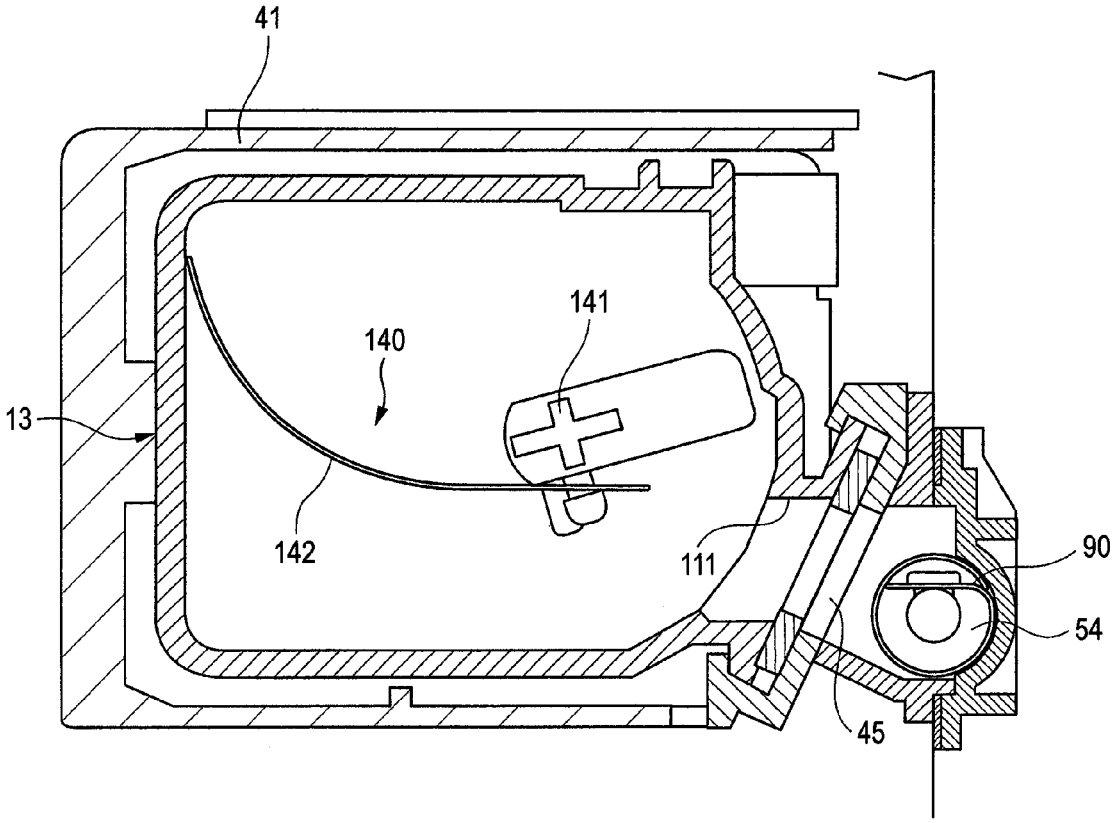
FIG. 21 illustrates a section view of a toner cartridge functioning as a developer storage portion, showing a state where it is mounted on a printer main body.

Further, inside the new toner storage vessel 104, as shown in FIG. 21, there is disposed an agitator 140 which, while stirring the toner stored within the new toner storage vessel 104, delivers the toner to the toner supply opening 11. This agitator 140, as shown in FIG. 21, is roughly composed of an agitator shaft 141 functioning as a rotation shaft member, and an agitator film 142 functioning as a rotary vane member.

A toner supplied from the toner supply opening 111 of the new toner storage vessel 104, as shown in FIG. 21, is fed to the inside of the toner introduction opening 45 formed in the housing 44 of the process cartridge 2. Also, in the agitator film 142, as shown in FIG. 19, there is cut formed a tongue piece 142*a* in such a manner that it enters the toner supply opening 111 to thereby prevent the toner from remaining within the toner supply opening 111.

Also, the toner introduction opening 45 formed in the housing 44 of the process cartridge 2 is in communication with the toner delivery path 55 of the toner delivery apparatus 52 and, as shown in FIG. 21, the toner received from the toner introduction opening 45 can be delivered to the developing device 11 by the toner delivery member 54 of the toner delivery apparatus 52.

Further, on the toner delivery member 54, as shown in FIG. 21, in order to prevent the toner remaining within the toner introduction opening 45, there is mounted a scrape-out piece 90 made of a Mylar film which is used to scrape out the toner from the toner introduction opening 45.

According to the present exemplary embodiment, as shown in FIG. 15, on the large diameter section 72 of the toner delivery member 54, there is provided a projection 86 which is used to fit and fix the scrape-out piece 90. The scrape-out piece 90 can be secured easily to the projection 86 by mounting the scrape-out piece 90 onto the projection 86 through a slit 87 formed in the scrape-out piece 90.

Figure 22:
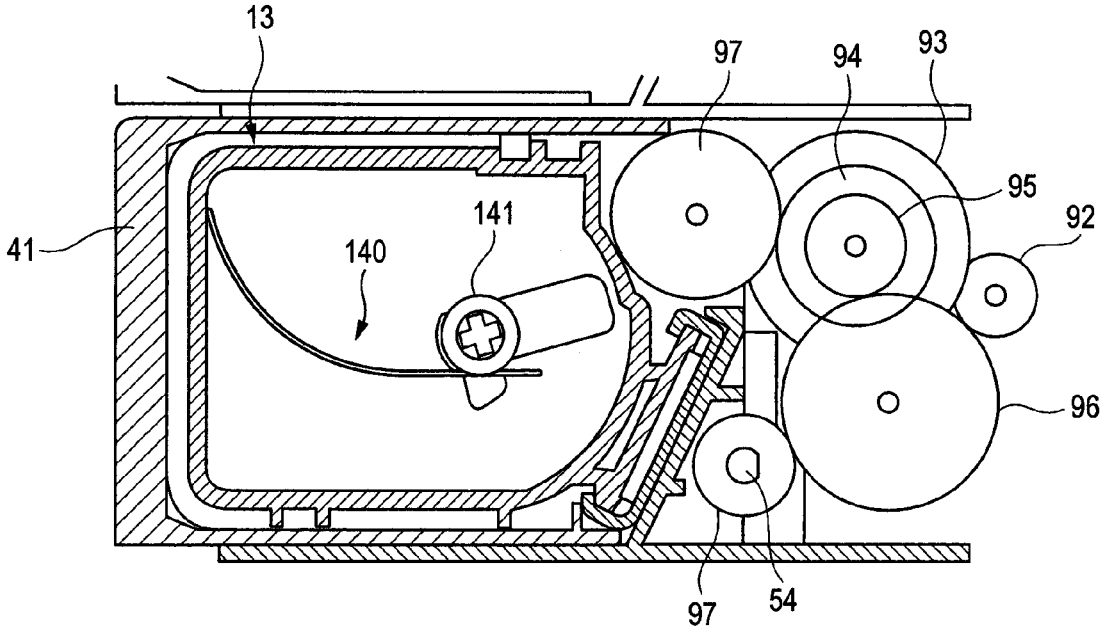
FIG. 22 illustrates a section view of a toner cartridge functioning as a developer storage portion, showing a state where it is mounted on a printer main body.
Figure 23:
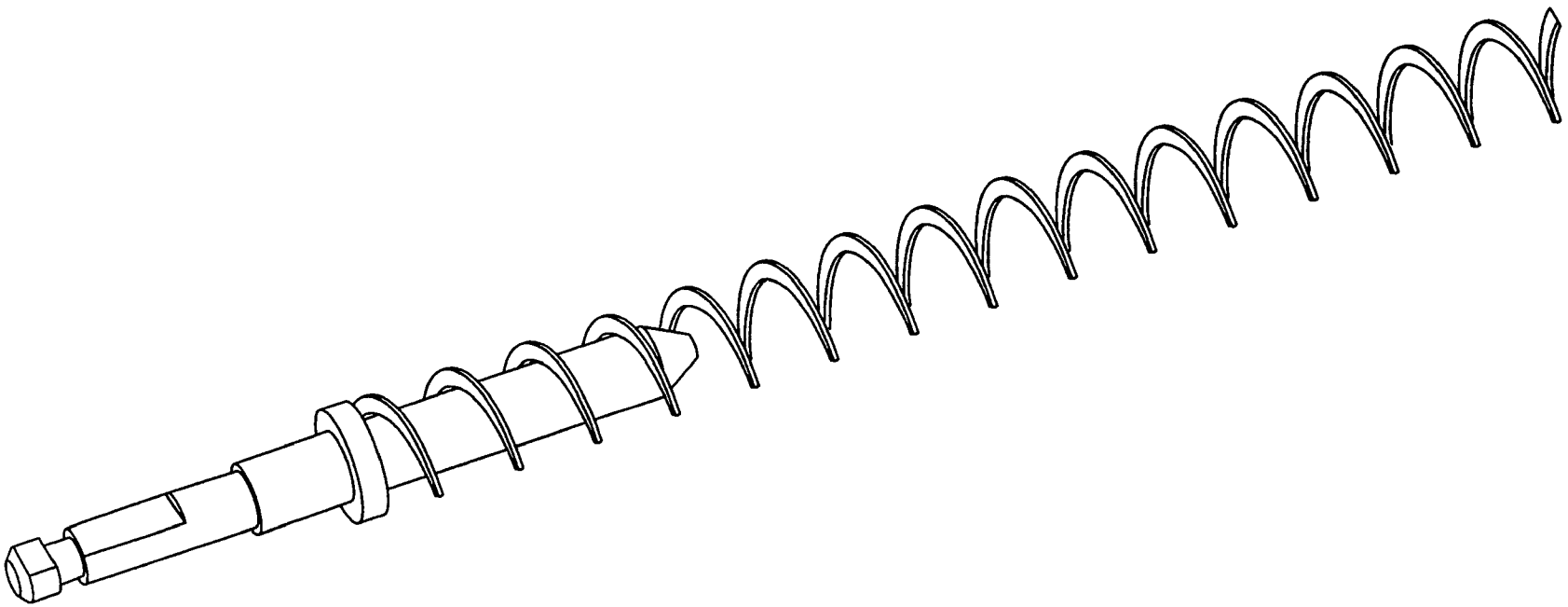
FIG. 23 illustrates a structure view of a conventional powder delivery member.

The toner delivery member 54 of the toner delivery apparatus 52 and the agitator 140 of the toner cartridge 13, as shown in FIGS. 7 and 22, can be driven and rotated by a drive motor 91 which is mounted on the printer main body 1. On the rotation shaft of the drive motor 91, there is mounted a drive gear 92 The drive gear 92 is in meshing engagement with a first idle gear 93 which is a part of an integrally structured idle gear assembly and has the largest diameter in the idle gear assembly; and also, the drive force of the drive gear 92 can be transmitted through a third idle gear 95 having the smallest diameter of the idle gear assembly and an intermediate gear 96 to a driven gear 97 which is mounted on the end portion of the toner delivery member 54.

Also, a second idle gear 94 having the second largest diameter in the idle gear assembly is in meshing engagement with a driven gear 99 mounted on the end portion of the agitator 140 through an intermediate gear 98, and it can be driven and rotated by the agitator 140.

As described above, when supplying the toner from the toner cartridge 13 to the developing device 11, as shown in FIGS. 7 and 22, by driving and rotating the drive motor 91 at a given timing for a given period of time, the toner can be supplied from the toner cartridge 13 through the toner delivery apparatus 52 to the developing device 11.

Referring to the above-mentioned structure, in the toner delivery apparatus according to the present exemplary embodiment, when delivering the powder using the powder delivering pipe-shaped member including a non-linear portion formed in a curved or bent shape, the clogged state of the inside of the pipe-shaped member with powders, and the resultant failure in powder delivery as well as the resultant breakage of the powder delivery member can be prevented in the following manner.

That is, in the toner delivery apparatus according to the present exemplary embodiment, as shown in FIG. 1, the toner delivery member 54 includes the axial core portion 70 and vane portion 71; and, the axial core portion 70 and vane portion 71 are both formed flexible. Thanks to this, even when the toner delivery pipe 53, as shown in FIG. 7, includes the curved or bent non-linear portions 55*a* and 55*b*, as shown in FIG. 8, the toner delivery member 54 can be deformed according to the shape of the toner delivery pipe 53.

And, since the toner delivery member 54 is structured such that the axial core portion 70 and delivering vane portion 71 are formed as an integral body, even when the toner delivery member 54 is held in a curved state, the toner can be positively delivered by the vane portion 71 that is provided on the outer periphery of the axial core portion 70 and thus the toner delivery pipe 53 can be prevented from being clogged with the toners in the intermediate portion thereof.

Also, since the toner delivery member 54 is formed of not metal or the like but a synthetic resin having flexibility by integral molding, even when the toner delivery member 54 receives loads repeatedly for a long period of time, there is no fear that it can be fatigue broken due to the repeated loads like metal material.

Exemplary Embodiment 2

Figure 24:
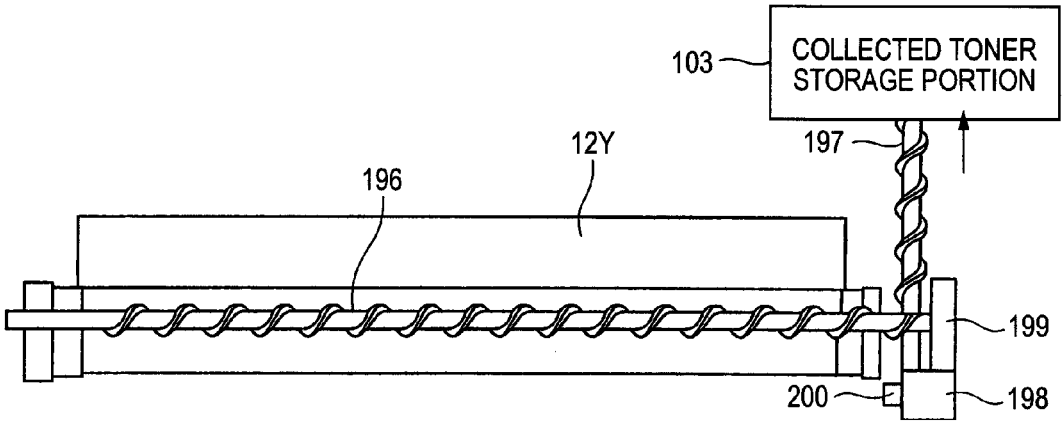
FIG. 24 illustrates a structure view of the main portions of a tandem-type full-color printer to which a powder delivery apparatus according to an exemplary embodiment 2 of the invention is applied.

FIG. 24 shows another exemplary embodiment 2 according to an aspect of the invention. The exemplary embodiment 2 includes a developing powder image hold unit for holding a developer image, a developer collect unit for collecting the developer from the developer image hold unit, a collected developer storage portion for storing collected developers, and a powder delivery unit for delivering the developer from the developer collect unit to the collected developer storage unit. The powder delivery unit includes a powder delivering pipe-shaped member having a curved or bent non-linear portion formed in at least a portion thereof, and a powder delivery member having an axial core portion disposed in the inside of the powder delivering pipe-shaped member and flexible according to the non-linear portion of the powder delivering pipe-shaped member, and a powder delivering flexible vane portion provided on the outer periphery of the axial core portion.

That is, the present exemplary embodiment 2, as shown in FIG. 24, includes cleaning devices 12Y, 12M, 12C and 12B respectively for collecting transfer residual toners from the surfaces of their associated sensitive drums 8Y, 8M, 8C and 8B; and, the transfer residual toners collected are stored into the inside of the cleaning devices 12Y, 12M, 12C and 12B.

And, the collected toners stored in the inside of the cleaning devices 12Y, 12M, 12C and 12B, as shown in FIG. 24, are delivered by a delivery auger 196 to the respective longitudinal direction one-end portions of the cleaning devices 12Y, 12M, 12C and 12B; and, after then, the toners are delivered to their associated toner delivery apparatuses functioning as a powder delivery unit which is provided on the one-end portions of the cleaning devices 12Y, 12M, 12C and 12B.

The toner delivery apparatus, similarly to the above-mentioned exemplary embodiment 1, includes roughly a toner delivery pipe functioning as a powder delivering pipe-shaped member having a curved or bent non-linear portion formed in at least a portion thereof, and a toner delivery member 197 having an axial core portion disposed in the inside of the toner delivering pipe-shaped member and flexible according to the non-linear portion of the toner delivering pipe-shaped member, and a powder delivering flexible vane portion provided on the outer periphery of the axial core portion.

By the way, in the illustrated exemplary embodiment, the toner delivery member 197 is shown in a linear shape. However, the toner delivery member 197 includes a curved or bent non-linear portion in at least a portion thereof in a direction perpendicular to the drawing.

And, the toner delivery member 197 is structured similarly to the exemplary embodiment 1; and, the transfer residual toners collected by the cleaning devices 12Y, 12M, 12C and 12B are delivered as the collected toners to the collected toner storage portion 103 of the toner cartridge 13 by the toner delivery apparatus.

According to the exemplary embodiment 2, for example, even when the cleaning devices 12Y, 12M, 12C and 12B and the collected toner storage portion 103 of the toner cartridge 13 are shifted from each other in the height direction, not only by curving or bending the toner delivery pipe but also by providing, in the inside of the toner delivery pipe, an axial core portion disposed in the inside of the toner delivery pipe and flexible according to the non-linear portion of the toner delivery pipe, and a powder delivering flexible vane portion formed on the outer periphery of the axial core portion, the collected toners can be delivered positively.

The other structures and operations of the exemplary embodiment 2 are similar to those of the exemplary embodiment 1 and thus the description thereof is omitted here.

Exemplary Embodiment 3

Figure 25:
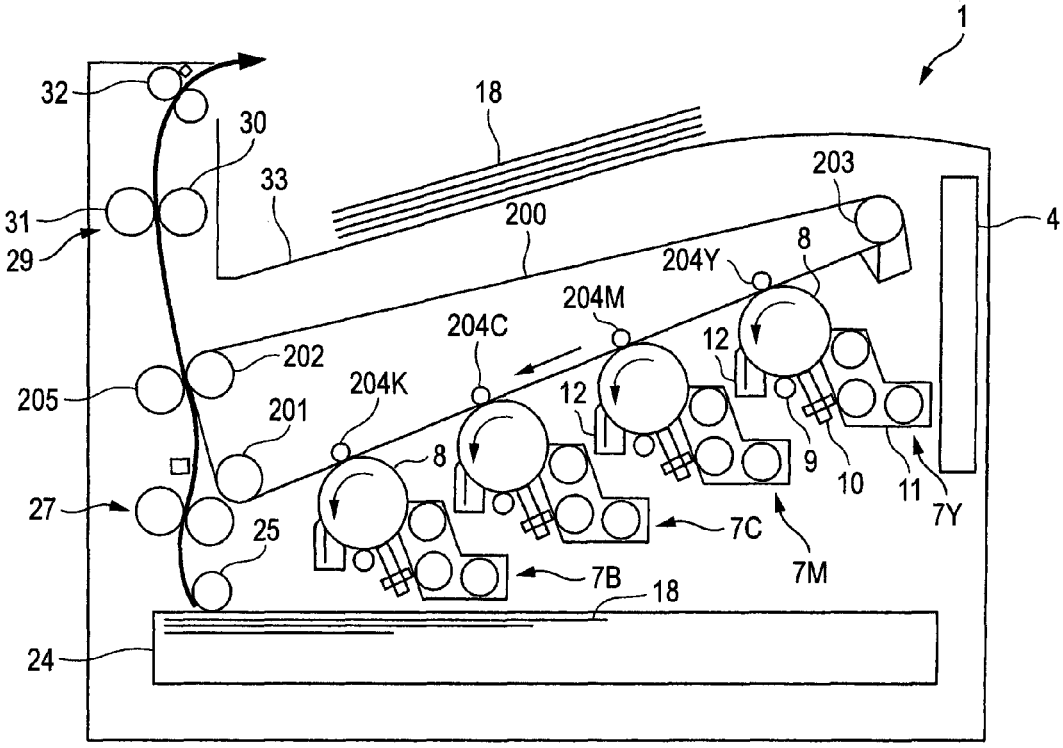
FIG. 25 illustrates a structure view of a tandem-type full-color printer of an intermediate transfer type to which a powder delivery unit according to an exemplary embodiment 3 of the invention is applied.

FIG. 25 shows still another exemplary embodiment 3 according to an aspect of the invention. The present exemplary embodiment 3 includes a developer image hold unit for holding a developer image, a developer collect unit for collecting the developer from the developer image hold unit, a collected developer storage portion for storing collected developers, and a powder delivery unit for delivering the developer from the developer collect unit to the collected developer storage unit. The powder delivery unit includes a powder delivering pipe-shaped member having a curved or bent non-linear portion formed in at least a portion thereof, and a powder delivery member having an axial core portion disposed in the inside of the powder delivering pipe-shaped member and flexible according to the non-linear portion of the powder delivering pipe-shaped member, and a powder delivering flexible vane portion provided on the outer periphery of the axial core portion.

That is, according to the present exemplary embodiment 3, as shown in FIG. 25, in the inside of the full-color printer main body 1, there are disposed four image forming portions 7Y, 7M, 7C and 7B of yellow (Y), magenta (M), cyan (C) and black (B) in an obliquely inclined manner and, on the upper portions of the four image forming portions 7Y, 7M, 7C and 7B, there is provided an intermediate transfer belt 200.

The above-mentioned four image forming portions 7Y, 7M, 7C and 7B of yellow (Y), magenta (M), cyan (C) and black (B) are all formed identical with each other, except for the colors of toner images to be formed. Each image forming portion 7 includes a sensitive drum 8 to be driven and rotated at a given speed along the arrow mark direction shown in FIG. 25, a charging roller 9 for charging the surface of the sensitive drum 8 uniformly, an LED exposure device 10 for exposing an image to the light according to the image data, a developing device 11, and a cleaning device 12.

Also, the intermediate transfer belt 200 is extended between and over a drive roller 201, a backup roller 202 and a driven roller 203 with a given tension, and can be moved in a circulating manner at a given speed by the drive roller 201.

And, the toner images of the respective colors, yellow (Y), magenta (M), cyan (C) and black (B) respectively formed by the four image forming portions 7Y, 7M, 7C and 7B are multi-color transferred on the intermediate transfer belt 200 by a primary transfer roller 204; and, after then, they are secondarily transferred all at once on a transfer sheet 18 by a secondary transfer roller 205.

According to the present exemplary embodiment 3, as shown in FIG. 25, as the developer image hold unit for holding a developer image, there is used the intermediate transfer belt 200; and, as the toner supply device for supplying a toner to the respective developing devices 11, there is used a similar device to the previously described exemplary embodiment 1.

The other structures and operations of the present exemplary embodiment 3 are similar to the exemplary embodiment 1 and thus the description thereof is omitted here.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A powder delivery member, comprising:

a flexible axial core portion; and a powder delivering flexible vane portion formed on an outer periphery of the axial core portion.

2. The powder delivery member according to claim 1, wherein the axial core portion comprises:

a large diameter section; and a small diameter section, the large diameter section having a larger diameter than the small diameter section, wherein the large diameter section is driven and rotated, and the small diameter section is flexible.

3. The powder delivery member according to claim 1, which has flexibility and comprises a material having a good sliding property.

4. The powder delivery member according to claim 3, wherein the material having a good sliding property is polyoxymethylene.

5. The powder delivery member according to claim 1, which is formed as a unified body by an injection molding method using a synthetic resin selected from the group consisting of polyoxymethylene, nylon, polyethylene and polyethylene terephthalate.

6. The powder delivery member according to claim 5, wherein the synthetic resin is polyoxymethylene.

7. A powder delivery apparatus, comprising:

a powder delivering pipe-shaped member having a curved or bent non-linear portion formed in at least a portion thereof; and a powder delivery member disposed inside of the powder delivering pipe-shaped member, the powder delivery member comprising:

an axial core portion flexible according to the non-linear portion of the powder delivering pipe-shaped member; and a powder delivering flexible vane portion formed on an outer periphery of the axial core portion.

8. The powder delivery apparatus according to claim 7, wherein the axial core portion of the powder delivery member comprises:

a large diameter section; and a small diameter section, the large diameter section having a larger diameter than the small diameter section, wherein the large diameter section is driven and rotated, and the small diameter section is flexible.

9. A frame apparatus, comprising:

a developer storage portion that stores a developer comprising a powder therein;

a developing unit that receives a developer from the developer storage portion; and a powder delivery unit that delivers a developer from the developer storage portion to the developing unit, the powder delivery unit comprising:

a powder delivering pipe-shaped member having a curved or bent non-linear portion formed in at least a portion thereof; and a powder delivery member disposed inside of the powder delivering pipe-shaped member, the powder delivery member comprising:

an axial core portion flexible according to the non-linear portion of the powder delivering pipe-shaped member; and a powder delivering flexible vane portion formed on an outer periphery of the axial core portion.

10. A frame apparatus, comprising:

a collected developer storage portion that stores a collected developer therein; and a powder delivery unit that delivers a developer collected in the collected developer storage portion, the powder delivery unit comprising:

a powder delivering pipe-shaped member having a curved or bent non-linear portion formed in at least a portion thereof; and a powder delivery member disposed inside of the powder delivering pipe-shaped member, the powder delivery member comprising:

an axial core portion flexible according to the non-linear portion of the powder delivering pipe-shaped member; and a powder delivering flexible vane portion formed on an outer periphery of the axial core portion.

11. An image forming apparatus, comprising:

an image carrier that forms an electrostatic latent image thereon according to image information;

a developing unit that develops an electrostatic latent image formed on the image carrier;

a developer storage portion that stores a developer; and a powder delivery unit that delivers a developer from the developer storage portion to the developing unit, the powder delivery unit comprising:

a powder delivering pipe-shaped member having a curved or bent non-linear portion formed in at least a portion thereof; and a powder delivery member disposed inside of the powder delivering pipe-shaped member, the powder delivery member comprising:

an axial core portion flexible according to the non-linear portion of the powder delivering pipe-shaped member; and a powder delivering flexible vane portion formed on an outer periphery of the axial core portion.

12. The image forming apparatus according to claim 11, wherein a developer supply opening formed in the developer storage portion is set lower than a developer receiving opening formed in the developing unit.

13. An image forming apparatus, comprising:

a developer image hold unit that holds a developer image;

a developer collect unit that collects a developer from the developer image hold unit;

a collected developer storage portion that stores a collected developer; and a powder delivery unit that delivers a developer from the developer collect unit to the collected developer storage portion, the powder delivery unit comprising:

a powder delivering pipe-shaped member having a curved or bent non-linear portion formed in at least a portion thereof; and a powder delivery member disposed inside of the powder delivering pipe-shaped member, the powder delivery member comprising:

an axial core portion flexible according to the non-linear portion of the powder delivering pipe-shaped member; and a powder delivering flexible vane portion formed on an outer periphery of the axial core portion.

14. A manufacturing apparatus for manufacturing a powder delivery member, comprising:

a metal assembly having an injection molding cavity corresponding to a shape of a powder delivery member comprising: a flexible axial core portion; and a powder delivering flexible vane portion formed on an outer periphery of the axial core portion, the metal assembly comprising first to fourth dies not only being capable of dividing the powder delivering vane portion of the powder deliver member into four sections along a peripheral direction thereof but also being removable therefrom in a plane intersecting at right angles to a longitudinal direction of the powder delivery member, wherein a synthetic resin forming the powder delivery member is injection molded into the injection molding cavity defined by the first to fourth dies and corresponding to the shape of the powder delivery member, so as to manufacture the powder delivery member.

15. A powder delivery member, comprising: an axial core portion; and a powder delivering flexible vane portion formed on an outer periphery of the axial core portion, wherein the powder delivery member is formed as a unified body by an injection molding method using a synthetic resin selected from the group consisting of polyoxymethylene, nylon, polyethylene and polyethylene terephthalate.

16. The powder delivery member according to claim 15, wherein the synthetic resin is polyoxymethylene.

17. A powder delivery member, comprising:

a flexible axial core portion; and a powder delivering vane portion formed on an outer periphery of the axial core portion;

wherein the axial core portion comprises:

a large diameter section; and a small diameter section, the large diameter section having a larger diameter than the small diameter section, wherein the large diameter section is driven and rotated.

* * * * *